US008272443B2

(12) United States Patent
Watson et al.

(10) Patent No.: US 8,272,443 B2
(45) Date of Patent: Sep. 25, 2012

(54) DOWNHOLE PROGRESSIVE PRESSURIZATION ACTUATED TOOL AND METHOD OF USING THE SAME

(75) Inventors: Brock Watson, Carrollton, TX (US); Gary Walters, Thornton, CO (US)

(73) Assignee: Halliburton Energy Services Inc., Duncan, OK (US)

( * ) Notice: Subject to any disclaimer, the term of this patent is extended or adjusted under 35 U.S.C. 154(b) by 429 days.

(21) Appl. No.: 12/617,405

(22) Filed: Nov. 12, 2009

(65) Prior Publication Data

US 2011/0108272 A1 May 12, 2011

(51) Int. Cl.
*E21B 43/25* (2006.01)
*E21B 34/08* (2006.01)

(52) U.S. Cl. ..... 166/318; 166/305.1; 166/319; 166/334.4

(58) Field of Classification Search ..... 166/318, 166/319, 334.4, 305.1, 308.1
See application file for complete search history.

(56) References Cited

U.S. PATENT DOCUMENTS

| | | | |
|---|---|---|---|
| 2,201,290 | A | 5/1940 | Greene |
| 2,913,051 | A | 11/1959 | Lister |
| 3,054,415 | A | 9/1962 | Baker et al. |
| 3,057,405 | A | 10/1962 | Mallinger |
| 3,216,497 | A | 11/1965 | Howard et al. |
| 3,434,537 | A | 3/1969 | Zandmer |
| 3,768,556 | A | 10/1973 | Baker |
| 4,081,990 | A | 4/1978 | Chatagnier |
| 4,105,069 | A | 8/1978 | Baker |
| 4,109,725 | A | 8/1978 | Williamson et al. |
| 4,150,994 | A | 4/1979 | Maternaghan |
| 4,417,622 | A | 11/1983 | Hyde |
| 4,469,136 | A | 9/1984 | Watkins |

(Continued)

FOREIGN PATENT DOCUMENTS

| | | | |
|---|---|---|---|
| GB | 2323871 | A | 10/1998 |

(Continued)

OTHER PUBLICATIONS

Halliburton brochure entitled "Delta Stim(TM) Sleeve," Mar. 2007, 2 pages, Halliburton.

(Continued)

*Primary Examiner* — Giovanna Wright
(74) *Attorney, Agent, or Firm* — John W. Wustenberg; Conley Rose, P.C.

(57) ABSTRACT

A method of servicing a subterranean formation comprising positioning a wellbore servicing tool comprising an axial flowbore within a wellbore, making a first application of pressure to the axial flowbore of the wellbore servicing tool; wherein the pressure within the wellbore servicing tool is at least a first upper threshold during the first application of pressure, allowing the pressure within the axial flowbore following the first application of pressure to fall below a first lower threshold, making a second application of pressure to the axial flowbore of the wellbore servicing tool, wherein the pressure within the wellbore servicing tool is at least a second upper threshold during the second application of pressure, allowing a second subsiding of pressure within the axial flowbore following the second application of pressure to fall a second lower threshold, and communicating a fluid to the wellbore, the subterranean formation, or both via one or more ports of the wellbore servicing tool.

26 Claims, 8 Drawing Sheets

U.S. PATENT DOCUMENTS 4,673,039 A 6/1987 Mohaupt
4,714,117 A 12/1987 Dech
4,893,678 A 1/1990 Stokley et al.
5,125,582 A 6/1992 Surjaatmadja et al.
5,127,472 A 7/1992 Watson et al.
5,180,016 A 1/1993 Ross et al.
5,323,856 A 6/1994 Davis et al.
5,325,917 A 7/1994 Szarka
5,325,923 A 7/1994 Surjaatmadja et al.
5,361,856 A 11/1994 Surjaatmadja et al.
5,366,015 A 11/1994 Surjaatmadja et al.
5,381,862 A 1/1995 Szarka et al.
5,396,957 A 3/1995 Surjaatmadja et al.
5,425,424 A 6/1995 Reinhardt et al.
5,484,016 A 1/1996 Surjaatmadja et al.
5,494,103 A 2/1996 Surjaatmadja et al.
5,494,107 A 2/1996 Bode
5,499,678 A 3/1996 Surjaatmadja et al.
5,499,687 A 3/1996 Lee
5,533,571 A 7/1996 Surjaatmadja et al.
5,765,642 A 6/1998 Surjaatmadja
5,826,661 A 10/1998 Parker et al.
5,865,252 A 2/1999 Van Petegem et al.
5,944,105 A 8/1999 Nguyen
5,947,205 A 9/1999 Shy
6,006,838 A 12/1999 Whiteley et al.
6,116,343 A 9/2000 Van Petegem et al.
6,119,783 A 9/2000 Parker et al.
6,152,232 A 11/2000 Webb et al.
6,167,974 B1 1/2001 Webb
6,189,618 B1 2/2001 Beeman et al.
6,216,785 B1 4/2001 Achee, Jr. et al.
6,244,342 B1 6/2001 Sullaway et al.
6,253,861 B1 7/2001 Carmichael et al.
6,286,599 B1 9/2001 Surjaatmadja et al.
6,318,470 B1 11/2001 Chang et al.
6,336,502 B1 1/2002 Surjaatmadja et al.
6,343,658 B2 2/2002 Webb
6,422,317 B1 7/2002 Williamson, Jr.
6,520,257 B2 2/2003 Allamon et al.
6,543,538 B2 4/2003 Tolman et al.
6,571,875 B2 6/2003 Bissonnette et al.
6,634,428 B2 10/2003 Krauss et al.
6,662,874 B2 12/2003 Surjaatmadja et al.
6,662,877 B2 12/2003 Patel
6,719,054 B2 4/2004 Cheng et al.
6,722,427 B2 4/2004 Gano et al.
6,725,933 B2 4/2004 Middaugh et al.
6,769,490 B2 8/2004 Allamon et al.
6,776,238 B2 8/2004 Dusterhoft et al.
6,779,607 B2 8/2004 Middaugh et al.
6,789,619 B2 9/2004 Carlson et al.
6,802,374 B2 10/2004 Edgar et al.
6,907,936 B2 6/2005 Fehr et al.
6,938,690 B2 9/2005 Surjaatmadja
6,997,252 B2 2/2006 Porter et al.
6,997,263 B2 2/2006 Campbell et al.
7,013,971 B2 3/2006 Griffith et al.
7,021,384 B2 4/2006 Themig
7,021,389 B2 4/2006 Bishop et al.
7,055,598 B2 6/2006 Ross et al.
7,066,265 B2 6/2006 Surjaatmadja
7,090,153 B2 8/2006 King et al.
7,096,954 B2 8/2006 Weng et al.
7,108,067 B2 9/2006 Themig et al.
7,134,505 B2 11/2006 Fehr et al.
7,159,660 B2 1/2007 Justus
7,168,493 B2 * 1/2007 Eddison ..... 166/334.4
7,195,067 B2 3/2007 Manke et al.
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,252,147 B2 8/2007 Badalamenti et al.
7,252,152 B2 8/2007 LoGiudice et al.
7,273,099 B2 9/2007 East, Jr. et al.
7,278,486 B2 10/2007 Alba et al.
7,287,592 B2 10/2007 Surjaatmadja et al.
7,290,611 B2 11/2007 Badalamenti et al.
7,296,625 B2 11/2007 East, Jr.
7,303,008 B2 12/2007 Badalamenti et al.
7,306,043 B2 12/2007 Toekje et al.
7,322,412 B2 1/2008 Badalamenti et al.
7,322,417 B2 1/2008 Rytlewski et al.
7,325,617 B2 2/2008 Murray
7,337,844 B2 3/2008 Surjaatmadja et al.
7,343,975 B2 3/2008 Surjaatmadja et al.
7,353,878 B2 4/2008 Themig
7,353,879 B2 4/2008 Todd et al.
7,377,321 B2 5/2008 Rytlewski
7,385,523 B2 6/2008 Thomeer et al.
7,387,165 B2 6/2008 Lopez de Cardenas et al.
7,398,825 B2 7/2008 Nguyen et al.
7,416,029 B2 8/2008 Telfer et al.
7,419,002 B2 9/2008 Dybevik et al.
7,422,060 B2 9/2008 Hammami et al.
7,431,090 B2 10/2008 Surjaatmadja et al.
7,431,091 B2 10/2008 Themig et al.
7,464,764 B2 12/2008 Xu
7,478,676 B2 1/2009 East, Jr. et al.
7,503,398 B2 3/2009 LoGiudice et al.
7,506,689 B2 3/2009 Surjaatmadja et al.
7,510,010 B2 3/2009 Williamson
7,510,017 B2 3/2009 Howell et al.
7,520,327 B2 4/2009 Surjaatmadja
7,527,103 B2 5/2009 Huang et al.
7,571,766 B2 8/2009 Pauls et al.
7,575,062 B2 8/2009 East, Jr.
7,617,871 B2 11/2009 Surjaatmadja et al.
7,628,213 B2 12/2009 Telfer
7,644,772 B2 1/2010 Avant et al.
7,661,478 B2 2/2010 Palmer et al.
7,665,545 B2 2/2010 Telfer
7,673,673 B2 3/2010 Surjaatmadja et al.
7,681,645 B2 3/2010 McMillin et al.
7,703,510 B2 4/2010 Xu
7,740,072 B2 6/2010 Surjaatmadja
7,740,079 B2 6/2010 Clayton et al.
7,748,460 B2 7/2010 Themig et al.
7,775,285 B2 8/2010 Surjaatmadja et al.
7,779,906 B2 8/2010 Porter et al.
7,849,924 B2 12/2010 Surjaatmadja et al.
7,861,788 B2 1/2011 Tips et al.
7,866,402 B2 1/2011 Williamson, Jr.
7,866,408 B2 1/2011 Allison et al.
7,870,907 B2 1/2011 Lembcke et al.
7,878,255 B2 2/2011 Howell et al.
7,926,571 B2 4/2011 Hofman
7,946,340 B2 5/2011 Surjaatmadja et al.
7,963,331 B2 6/2011 Surjaatmadja et al.
8,162,050 B2 4/2012 Roddy et al.
8,191,625 B2 6/2012 Porter et al.
2003/0029611 A1 2/2003 Owens
2006/0086507 A1 4/2006 Surjaatmadja et al.
2006/0157257 A1 7/2006 Ross et al.
2007/0102156 A1 5/2007 Nguyen et al.
2007/0261851 A1 11/2007 Surjaatmadja
2007/0272411 A1 11/2007 Lopez De Cardenas et al.
2007/0284114 A1 12/2007 Swor et al.
2008/0000637 A1 1/2008 McDaniel et al.
2008/0060810 A9 3/2008 Nguyen et al.
2008/0135248 A1 6/2008 Talley et al.
2008/0202764 A1 8/2008 Clayton et al.
2008/0264641 A1 10/2008 Slabaugh et al.
2009/0308588 A1 12/2009 Howell et al.
2010/0000727 A1 1/2010 Webb et al.
2011/0036590 A1 * 2/2011 Williamson et al. ..... 166/373
2012/0061105 A1 3/2012 Neer et al.

FOREIGN PATENT DOCUMENTS

GB 2415213 B 1/2009
WO 2008070051 A2 6/2008
WO 2008070051 A3 6/2008
WO 2008070051 B1 6/2008
WO 2008093047 A1 8/2008
WO 2009132462 A1 11/2009

OTHER PUBLICATIONS

Halliburton brochure entitled "Swellpacker® cable system," Aug. 2008, 2 pages, Halliburton.
Patent application entitled "High rate stimulation method for deep, large bore completions," by Malcolm Joseph Smith, et al., filed on Jan. 22, 2009 as U.S. Appl. No. 12/358,079.
Foreign communication from a related counterpart application—International Search Report and Written Opinion, PCT/GB2008/002646, Dec. 11, 2008, 8 pages.
Foreign Communication from a related counterpart application—International Search Report and Written Opinion, PCT/GB2007/004628, Feb. 26, 2008, 8 pages.
Foreign commuunication from a related counterpart application—International Search Report and Written Opinion, PCT/GB2009/001505, Feb. 8, 2011, 8 pages.
Foreign communication from a related counterpart application—International Search Report and Written Opinion, PCT/GB2009/002693, Mar. 2, 2010, 8 pages.
Foreign communication from a related counterpart application—International Search Report and Written Opinion, PCT/GB2010/001524, Apr. 13, 2011, 11 pages.
Halliburton brochure entitled "Delta Stim® Completion Service," Sep. 2008, 4 pages, Halliburton.
Halliburton brochure entitled "RapidFrac™ System," Mar. 2011, 3 pages.
Halliburton brochure entitled "sFrac™ Valve," Jun. 2010, 3 pages, Halliburton.
Halliburton Marketing Data Sheet, Sand Control, EquiFlow™ Inflow Control Devices, HO5600,01/08, pp. 1-2.
The Lee Company brochure entitled "Meet the EFS family," http://www.theleeco.com/EFSWEB2.NSF/Products! OpenPage, Apr. 21, 2009, 1 page.
The Lee Company brochure entitled "Meet the precision microhydraulics family," http.//www.theleeco.com/LEEWEB2.NSF/AeroStart!OpenPage, Apr. 21, 2009, 2 pages.
Lohm calculator for gas flow, http://www.theleeco.com/EFSWEB2.NSF/airlohms.htm, Apr. 21, 2009, 2 pages, courtesy of The Lee Company.
Lohm calculator for liquid flow, http://www.theleeco.com/EFSWEB2.NSF/flowcalc.htm, Apr. 21, 2009, 2 pages, courtesy of the Lee Company.
Office Action (Final) dated Sep. 15, 2009 (12 pages), U.S. Appl. No. 11/609,128 filed Dec. 11, 2006.
Office Action dated Feb. 18, 2009 (18 pages), U.S. Appl. No. 11/609,128 filed Dec. 11, 2006.
Office Action dated Jun. 24, 2010 (13 pages), U.S. Appl. No. 12/139,604 filed Jun. 16, 2008.
Office Action dated Dec. 22, 2009 (18 pages), U.S. Appl. No. 12/139,604 filed Jun. 16, 2008.
Office Action (Final) dated Aug. 12, 2011 (12 pages), U.S. Appl. No. 12/166,257 filed Jul. 1, 2008.
Office Action dated Mar. 31, 2011 (19 pages), U.S. Appl. No. 12/166,257 filed Jul. 1, 2008.
Office Action dated Aug. 9, 2011, U.S. Appl. No. 12/539,392 filed Aug. 11, 2009.
Packers Plus brochure entitled "Achieve immediate production; StackFRAC® HD," Mar. 11, 2011, 4 pages.
Patent application entitled "A Method for individually servicing a plurality of zones of a subterranean formation," by Matthew Todd Howell, filed Feb. 10, 2011 as U.S. Appl. No. 13/025,039.
Patent application entitled "System and method for servicing a wellbore," by Jesse Cale Porter, et al., filed Feb. 10, 2011 as U.S. Appl. No. 13/025,041.
Patent application entitled "System and method for servicing a wellbore," by Jesse Cale Porter, et al., filed Jun. 2, 2011 as U.S. Appl. No. 13/151,457.
Patent application entitled "System and method for servicing a wellbore," by Matthew James Merron, et al., filed Aug. 23, 2011 as U.S. Appl. No. 13/215,553.
Patent application entitled "Responsively activated wellbore stimulation assemblies and methods of using the same," by Brock William Miller, filed Jun. 8, 2011 as U.S. Appl. No. 13/156,155.
Foreign communication from a related counterpart application—International Search Report and Written Opinion, PCT/GB2010/002090, Aug. 12, 2011, 11 pages.
Packers Plus® Case Study entitled "Packers Plus launches the StackFRAC® HD "High Density" Multi-Stage Fracturing System to fulfill operator demand for more stimulation stages to increase production," 1 page.
Packers Plus brochure entitled "High Density Multi-Stage Fracturing System; StackFRAC® HD," Apr. 20, 2010, 2 pages.
Office Action dated Apr. 4, 2012 (21 pages), U.S. Appl. No. 12/539,392 filed Aug. 11, 2009.
Office Action dated Apr. 4, 2012 (21 pages), U.S. Appl. No. 12/539,392, filed Aug. 11, 2009.
Patent application entitled "Responsively activated wellbore stimulation assemblies and methods of using the same," by William Mark Norrid, et al., filed Sep. 29, 2011 as U.S. Appl. No. 13/248,145.
Patent application entitled "Delayed activation activatable stimulation assembly," by Matthew James Merron, filed Apr. 30, 2012 as U.S. Appl. No. 13/460,453.
Foreign communication from a related counterpart application—International Search Report and Written Opinion, PCT/GB2012/000140, May 30, 2012, 11 pages.

* cited by examiner

DOWNHOLE PROGRESSIVE PRESSURIZATION ACTUATED TOOL AND METHOD OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a fracturing fluid may be introduced into a portion of a subterranean formation penetrated by a wellbore at a hydraulic pressure sufficient to create or enhance at least one fracture therein. Stimulating or treating the wellbore in such ways increases hydrocarbon production from the well. Fracturing equipment may be incorporated within a casing string used in the overall production process. Alternatively a casing string comprising fracturing equipment may be removably placed in the wellbore during and/or after completion operations. The casing string and fracturing equipment may be run into the wellbore to a predetermined depth. Various "zones" in the subterranean formation may be isolated via the operation of one or more packers, which may also help to secure the casing string and fracturing equipment in place.

Following placement of the casing string and fracturing equipment within the wellbore, it may be desirable to "pressure test" the casing string and fracturing equipment to ensure the integrity of both, for example, to ensure that a hole or leak has not developed during placement of the casing string and fracturing equipment. Pressure-testing generally involves pumping a fluid into the axial flowbore of the casing string such that a pressure is internally applied to the casing string and the fracturing equipment and maintaining that hydraulic pressure for sufficient period of time to ensure that a hole or leak has not developed. To accomplish this, no fluid pathway out of the casing string can be open, for example, all ports or windows of the fracturing equipment, as well as any additional routes of fluid communication, must be closed or restricted.

After a first pressure test has been performed and the integrity of the casing string and fracturing equipment has been confirmed, surface equipment may be removed and a period of time, sometimes several weeks or more, may pass. The well may be left unattended during this period of time. When ready to initiate a fracturing operation, the operator may often wish to perform a second pressure test to ensure that the integrity of the casing or fracturing equipment has not been compromised.

After the second pressure test, fracturing operations may commence. Such operations will require that a route of fluid communication out of the casing string and/or fracturing equipment be provided, either for the purpose of communicating fluid to the subterranean formation or circulating a device so as to actuate the fracturing equipment.

Conventionally, differential valves have been employed to provide a fluid pathway out of the casing string after a pressure test. Such differential valves are designed to open after a threshold pressure is reached. However, differential valves are often inaccurate as to the pressure at which they will open. Further, once a differential valve has been opened, it cannot be closed. Therefore, differential valves only allow for one pressure test at the threshold pressure. If a second pressure test is desired, either an obturating means (e.g., a dart or ball) must be employed to block of the fluid pathway via the differential valve or the first pressure test cannot reach a pressure at or approaching the threshold pressure at which the differential valve will open. Further still, once a pressure test has been performed at or near the threshold pressure, the well will be open, making it difficult if not impossible to achieve wellbore control following the first pressure test and thereby posing various risks, for example blow-outs or the loss of hydrocarbons. Therefore, there is a need for a tool which would provide a fluid pathway following the final of multiple pressure tests while maintaining wellbore control prior to completion of the final pressure test.

SUMMARY

Disclosed herein is a method of servicing a subterranean formation comprising positioning a wellbore servicing tool comprising an axial flowbore within a wellbore, making a first application of pressure to the axial flowbore of the wellbore servicing tool; wherein the pressure within the wellbore servicing tool is at least a first upper threshold during the first application of pressure, allowing the pressure within the axial flowbore following the first application of pressure to fall below a first lower threshold, making a second application of pressure to the axial flowbore of the wellbore servicing tool, wherein the pressure within the wellbore servicing tool is at least a second upper threshold during the second application of pressure, allowing a second subsiding of pressure within the axial flowbore following the second application of pressure to fall a second lower threshold, and communicating a fluid to the wellbore, the subterranean formation, or both via one or more ports of the wellbore servicing tool.

Further disclosed herein is a wellbore servicing tool comprising a cylindrical body comprising an axial flowbore and one or more ports, a first sliding sleeve concentrically inserted within the cylindrical body and configured such that a first application of pressure within the axial flowbore will cause the first sliding sleeve to move within the cylindrical body, a second sliding sleeve concentrically inserted within the cylindrical body and configured such that a subsiding of the first application of pressure with the axial flowbore will cause the second sliding sleeve to move within the cylindrical body, a third sliding sleeve concentrically inserted within the cylindrical body and configured such that a second application of pressure within the axial flowbore will cause the third sliding sleeve to move within the cylindrical body, and a fourth sliding sleeve concentrically inserted within the cylindrical body and configured such that a subsiding of the second application of pressure with the axial flowbore will cause the second sliding sleeve to move within the cylindrical body, thereby exposing the ports.

Also disclosed herein is a method of servicing a subterranean formation comprising positioning a wellbore servicing tool comprising an axial flowbore within a wellbore, making a first application of pressure to the axial flowbore of the wellbore servicing tool, wherein the pressure within the wellbore servicing tool is at least an upper threshold during the first application of pressure, and allowing the first application of pressure within the axial flowbore to fall below a lower threshold, wherein the axial flowbore of the wellbore servicing tool remains isolated from the wellbore, the subterranean formation, or both until after making a second application of pressure of at least an upper threshold to the axial flowbore of the wellbore servicing tool and allowing the second application of pressure within the axial flowbore to fall below a lower threshold.

Also disclosed herein is a method of servicing a subterranean formation comprising accessing a wellbore having disposed therein a wellbore servicing tool, wherein a first application of pressure of at least an upper threshold has been made to an axial flowbore of the wellbore servicing tool and wherein the first application of pressure within the axial flowbore has been allowed to fall below a lower threshold, making a second application of pressure to the axial flowbore of the wellbore servicing tool, wherein the pressure within the wellbore servicing tool is at least an upper threshold during the second application of pressure, allowing the second application of pressure within the axial flowbore to fall below a lower threshold, and communicating a fluid to the wellbore, the subterranean formation, or both via a one or more ports of the wellbore servicing tool.

Also disclosed herein is a wellbore servicing apparatus comprising a body comprising one or more ports, an axial flowbore, a first sleeve slidably fitted within the body and selectively retained relative to the body, a second sleeve slidably fitted within the body abutting the first sleeve and biased toward the first sleeve, a third sleeve slidably fitted within the body abutting the second sleeve and selectively retained relative to the body, and a fourth sleeve slidably fitted within the body abutting the third sleeve and biased toward the third sleeve, wherein the fourth sleeve obstructs fluid communication between the axial flowbore and the one or more ports.

Also disclosed herein is a method of servicing a wellbore comprising positioning a wellbore servicing apparatus comprising a body comprising one or more ports, an axial flowbore, a first sleeve slidably fitted within the body and selectively retained relative to the body, a second sleeve slidably fitted within the body abutting the first sleeve and biased toward the first sleeve, a third sleeve slidably fitted within the body abutting the second sleeve and selectively retained relative to the body, and a fourth sleeve slidably fitted within the body abutting the third sleeve and biased toward the third sleeve, wherein the fourth sleeve obstructs fluid communication between the axial flowbore and the one or more ports, applying a first application of pressure to the axial flowbore such that the first sleeve slides within the body, allowing the pressure within the axial flowbore following the first application of pressure to subside, thereby allowing the second sleeve to slide within the body, applying a second application of pressure to the axial flowbore such that the third sleeve slides within the body, allowing the pressure within the axial flowbore following the first application of pressure to subside, thereby allowing the fourth sleeve to slide within the body such that the fourth sleeve no longer obstructs fluid communication between the axial flowbore and the one or more ports.

DETAILED DESCRIPTION

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation or the surface of a body of water; likewise, use of "down," "lower," "downward," "downhole," "downstream," or other like terms shall be construed as generally away from the surface of the formation or the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

The devices, methods, and systems disclosed herein may generally refer to one or more embodiments wherein a tubular, for example a casing string or liner, comprising one or more manipulatable fracturing tools is positioned within a wellbore penetrating a subterranean formation. Prior to the commencement of fracturing operations, it may be desirable to pressure test the casing string or liner and thereby verify its integrity and functionality. In embodiments disclosed herein, a progressive pressurization actuated tool is incorporated within the tubular to enable pressurization thereof without communicating fluid to the subterranean formation or wellbore and thereby maintaining well control. After a predetermined number of cycles of pressurizing the tubular and allowing the pressure to subside, the ports of the progressive pressurization actuated tool will open, thereby allowing fluid communication with the wellbore, the subterranean formation, or both. Although, a progressive pressurization actuated tool is referred to as being incorporated within a casing string in one or more the following embodiments, the specification should not be construed as so-limiting. A progressive pressurization actuated tool may similarly be incorporated within other suitable tubulars such as work strings or liners.

Figure 1:
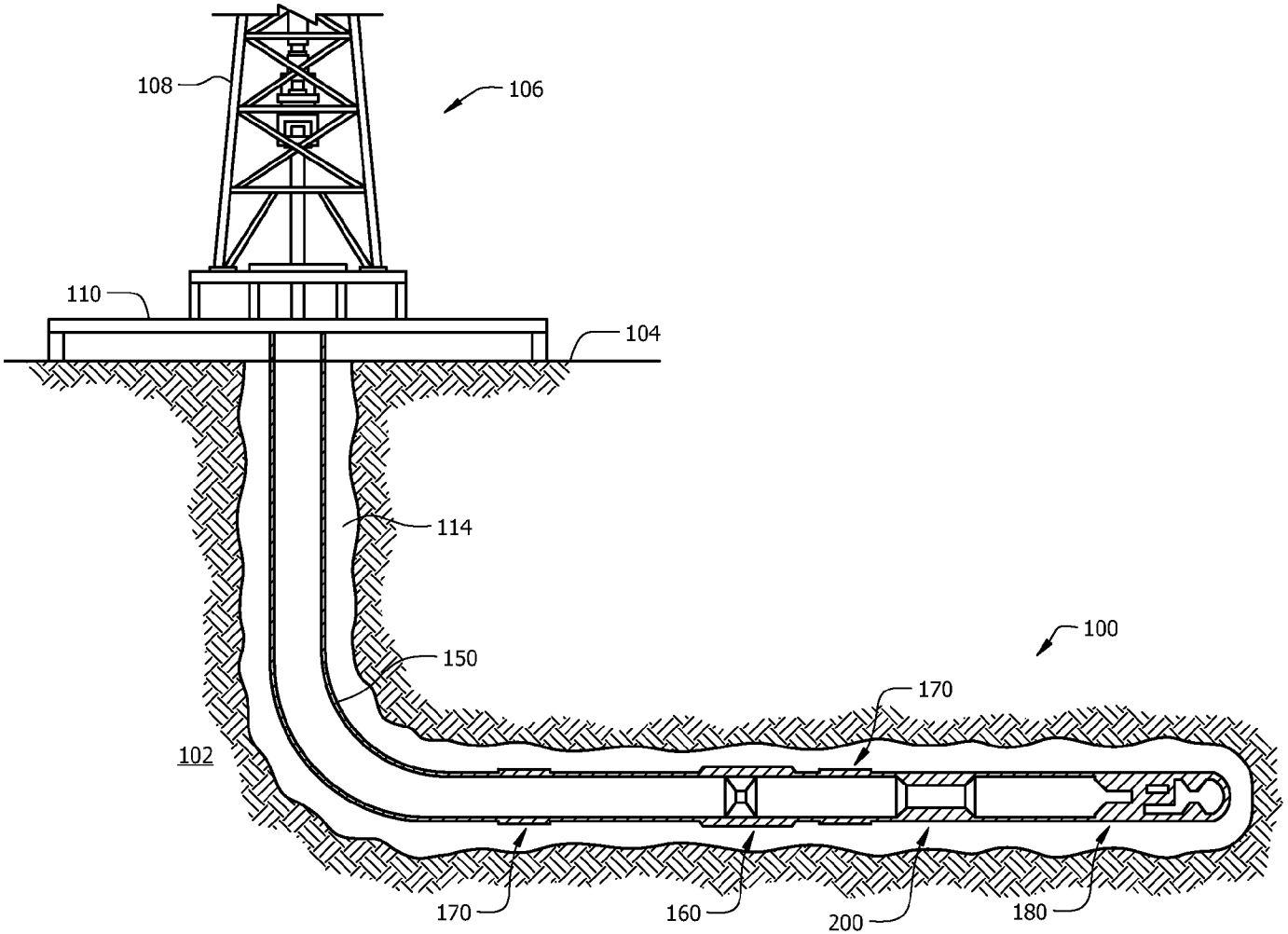
FIG. 1 is a partial cutaway view of the operating environment of the invention depicting a wellbore penetrating a subterranean formation and a casing string positioned within the wellbore, the casing string comprising one or more packers, a manipulatable servicing tool, a progressive pressurization actuated tool, and a float shoe.

Referring to FIG. 1, an embodiment of an operating environment for a progressive pressurization actuated tool (PPAT) and a method of using the same is illustrated. It is noted that although some of the figures may exemplify horizontal or vertical wellbores, the principles of the foregoing devices, systems, and methods are likewise applicable to horizontal and conventional vertical wellbore configurations. The horizontal or vertical nature of any figure is not to be construed as limiting the wellbore to any particular configuration. As depicted, the operating environment comprises a drilling or servicing rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. In an embodiment, the drilling or servicing rig 106 comprises a derrick 108 with a rig floor 110 through which a casing string 150 is positioned within the wellbore 114. In an embodiment, incorporated within the casing string 150 is a wellbore servicing apparatus 100 or some part thereof. The wellbore servicing apparatus 100 may be delivered to a predetermined depth within the wellbore 114 to perform a servicing operation, for example, fracturing the formation 102, expanding or extending a fluid path there-through, producing hydrocarbons from the formation 102, or other servicing operation. The drilling or servicing rig 106 may be conventional and may comprise a motor driven winch and other associated equipment for lowering the casing string 150 into the wellbore 114 and to position the wellbore servicing apparatus 100 at the desired depth. In another embodiment, the wellbore servicing apparatus 100 or some part thereof may be comprised along and/or integral with a liner.

The wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved. In some instances, a portion the casing string 150 may be secured into position against the formation 102 in a conventional manner using cement. In alternative operating environments, the wellbore 114 may be partially cased and cemented thereby resulting in a portion of the wellbore 114 being uncemented.

While the exemplary operating environment depicted in FIG. 1 refers to a stationary drilling or servicing rig 106 for lowering and setting the wellbore servicing apparatus 100 within a land-based wellbore 114, one of ordinary skill in the art will readily appreciate that mobile workover rigs, wellbore servicing units (e.g., coiled tubing units), and the like may be used to lower the wellbore servicing apparatus 100 into the wellbore 114. It should be understood that the wellbore servicing apparatus 100 may alternatively be used in other operational environments, such as within an offshore wellbore operational environment. As shown in FIG. 1, in an embodiment the wellbore servicing apparatus comprises one or more manipulatable servicing tools 160, one or more packers 170, a float shoe 180, and the PPAT 200.

In an embodiment, the PPAT 200 may be configured so as to allow fluid to be emitted from therefrom only after completing a predetermined number of cycles of pressurizing the PPAT 200 (i.e., applying an internal pressure to above a threshold) and allowing the pressure to subside thereafter (referred to herein as a "pressurization cycle"). In an embodiment, the PPAT 200 may generally comprise a cylindrical body, two or more sliding sleeves, and one or more ports for the communication of fluid between the tool and the subterranean formation 102, the wellbore 114, or both when the tool is so-configured.

Referring to FIGS. 2A-2E, in an embodiment the PPAT 200 comprises a body 210. In the embodiment of FIGS. 2A-2E, the body 210 of the PPAT 200 is a generally cylindrical or tubular-like structure. The body 210 may comprise a unitary structure; alternatively, the body 210 may be made up of two or more operably connected components (e.g., an upper component, a middle component, and a lower component as shown in FIGS. 2A-2E). Alternatively, a body of a PPAT 200 may comprise any suitable structure, such suitable structures will be appreciated by those of skill in the art with the aid of this disclosure.

As shown in FIG. 1, in an embodiment the PPAT 200 may be configured for incorporation into the casing string 150. In such an embodiment, the body 210 may comprise a suitable connection to the casing string 150 (e.g., to a casing string member). For example, as illustrated in FIGS. 2A-2E, terminal ends of the body 210 of the PPAT 210 comprise one or more internally or externally threaded surfaces 212 suitably employed in making a threaded connection to the casing string 150. Alternatively, a PPAT may be incorporated within a casing string be any suitable connection. Suitable connections to a casing member will be known to those of skill in the art.

In the embodiment of FIGS. 2A-2E, the interior surface of the body 210 defines an axial flowbore 230. Referring again to FIG. 1, the PPAT 200 is incorporated within the casing string 150 such that the axial flowbore 230 of the PPAT 200 is in fluid communication with the axial flowbore of the casing string 150.

In the embodiment of FIGS. 2A-2E, the body 210 comprises one or more ports 220. In this embodiment, the ports 220 extend radially outward from and/or inward toward the axial flowbore 230. As such, the ports 220 may provide a route of fluid communication from the axial flowbore 230. The PPAT may be configured such that the ports 220 provide a route of fluid communication between the axial flowbore 230 and the wellbore 114 and/or subterranean formation 102 (e.g. when the ports 220 are unobstructed). Alternatively, the PPAT may be configured such that no fluid will be communicated via the ports 220 between the axial flowbore 230 and the wellbore 114 and/or subterranean formation 102 (e.g., when the ports 220 are obstructed).

In the embodiment of FIG. 2A-2E, the body 210 comprises a recessed raceway 214. In this embodiment, the recessed raceway 214 is generally defined by an upper shoulder 214*a*, a lower shoulder 214*b*, and the recessed bore surface 214*c* extending between the upper shoulder 214*a* and lower shoulder 214*b*. The recessed raceway 214 may comprise a pathway in which the sliding sleeves, the operation of which will be discussed in greater detail herein, may move generally parallel to the axial flowbore 230. In an embodiment, the recessed raceway 214 comprises one or more grooves to align one or more of the sliding sleeves.

In the embodiment of FIGS. 2A-2E, the PPAT 200 comprises multiple sliding sleeves. Particularly, in this embodiment the PPAT 200 comprises a first sliding sleeve 240, a second sliding sleeve 250, a third sliding sleeve 260, and a fourth sliding sleeve 270. In an alternative embodiment, a PPAT like PPAT 200 may further comprise additional sliding sleeves, for example a fifth, sixth, seventh, eight, or more sliding sleeve.

In the embodiment of FIGS. 2A-2E, each of the first sliding sleeve 240, the second sliding sleeve 250, the third sliding sleeve 260, and the fourth sliding sleeve 270 are positioned concentrically within the cylindrical body 210. In the embodiment of FIGS. 2A-2E, the first sliding sleeve 240 is the uppermost of the sliding sleeves (i.e., the first sliding sleeve 240 is generally positioned up the PPAT from the second sliding sleeve 250, third sliding sleeve 260, and fourth sliding sleeve 270). Likewise, in this embodiment, the second sliding sleeve 250 is the second uppermost of the sliding sleeves, the third sliding sleeve 260 is the third uppermost of the sliding sleeves, and the fourth sliding sleeve 270 is the fourth uppermost of the sliding sleeve (i.e., the second sliding sleeve is generally positioned up the PPAT from the third and fourth sliding sleeves 260 and 270, and the third sliding sleeve is generally positioned up the PPAT from the fourth sliding sleeve 270).

In an alternative embodiment, the orientation of a tool such as the PPAT may be reversed from the embodiment illustrated in FIGS. 2A-2E. That is, the orientation and order in which the sliding sleeves are arranged within the may be reversed from the embodiment illustrated in FIGS. 2A-2E. In such an embodiment, a first sliding sleeve like first sliding sleeve 240 may be the lowermost of the sliding sleeves, a second sliding sleeve like second sliding sleeve 250 may be the second lowermost of the sliding sleeves, a third sliding sleeve like third sliding sleeve 260 may be the third lowermost of the sliding sleeves, and a fourth sliding sleeve like fourth sliding sleeve 270 may be the fourth lowermost (i.e., uppermost) of the sliding sleeves.

Figure 3:
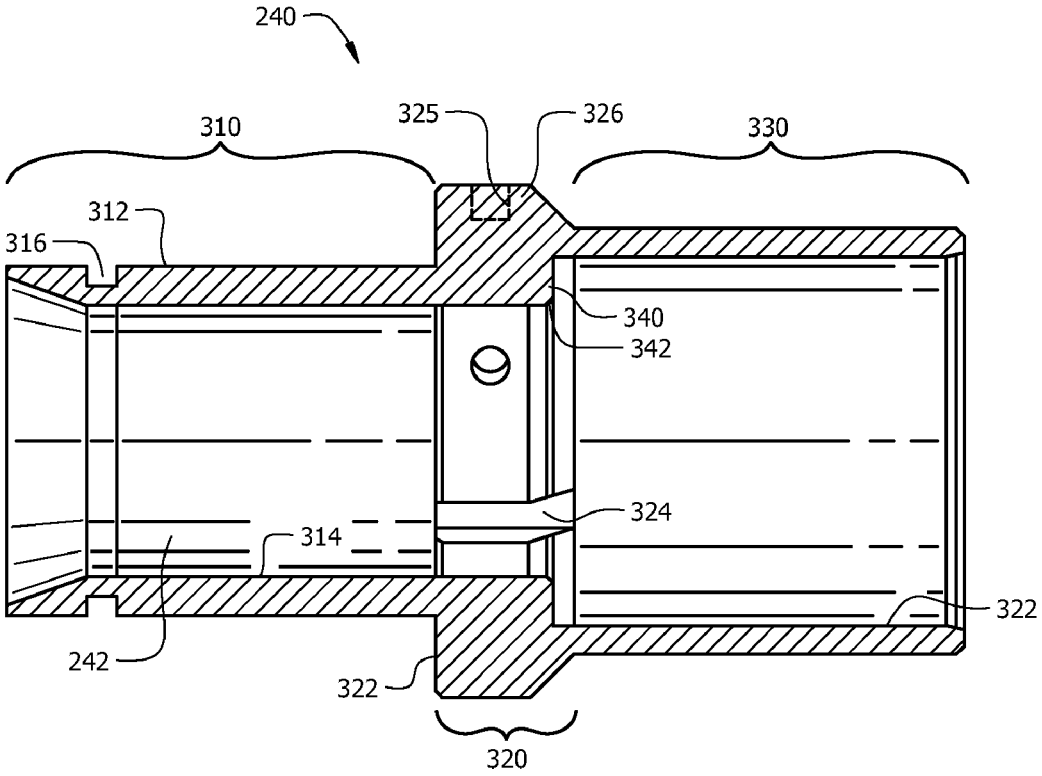
FIG. 3 is a cutaway view of a first sliding sleeve of a progressive pressurization actuated tool.

Referring to FIG. 3, the first sliding sleeve 240 is shown in isolation. In this embodiment, the first sliding sleeve 240 is generally cylindrical or tubular. In this embodiment, the first sliding sleeve 240 comprises an axial bore 242 extending therethrough.

In the embodiment of FIG. 3, the first sliding sleeve 240 generally comprises an axial flowbore interaction portion 310, a recessed raceway interaction portion 320, a second sliding sleeve interaction portion 330, and a downhole orthogonal face 340. In the embodiment of FIG. 3, the axial flowbore interaction portion 310, the recessed raceway interaction portion 320, the second sliding sleeve interaction portion 330, and the downhole orthogonal face 340 comprise a single solid piece. Alternatively, the axial flowbore interaction portion 310, the recessed raceway interaction portion 320, and the second sliding sleeve interaction portion 330 may be comprise two or more pieces coupled together, as will be appreciated by those of skill in the art.

In the embodiment of FIG. 3, the axial flowbore interaction portion 310 comprises an outer cylindrical surface 312 and an inner cylindrical surface 314. As shown in FIGS. 2A-2E, the outer cylindrical surface 312 is configured to slidably fit against a portion of the inner surface of the body 210. The outer cylindrical surface 312 may be fitted against the inner surface of the body in a substantially fluid-tight manner. The axial flowbore interaction portion 310 may comprise a groove 316 for the placement of a sealing or locking mechanism (e.g., an O-ring, snap-ring, or, lock-ring).

In the embodiment of FIG. 3, the recessed raceway interaction portion 320 is immediately adjacent to and below the axial flowbore interaction portion 310. In the embodiment of FIG. 3 and as shown in FIGS. 2A-2E, the recessed raceway interaction portion 320 comprises an outer surface 326 which is configured to slidably fit against recessed bore surface 214*c* of the recessed raceway 214. The recessed raceway interaction portion 320 may comprise an upper shoulder 322. As shown in FIG. 3, the recessed raceway interaction portion 320 may comprise one or more conduits 324 (e.g., channels or grooves), thereby allowing for the passage of a fluid or liquid material from the uphole side of the recessed raceway interaction portion 320 to the downhole side thereof or from the downhole side thereof to the uphole side thereof.

In the embodiment of FIG. 3, the second sliding sleeve interaction portion 330 is immediately adjacent to and below the recessed raceway interaction portion 320. As shown in FIGS. 2A-2E, the second sliding sleeve interaction portion 330 is configured to slidably fit about a portion of the second sliding sleeve 250. In the embodiment of FIG. 3, the second sliding sleeve interaction portion 330 comprises an inner cylindrical surface 332 which may be slidably fitted against a portion of second sliding sleeve 250. As shown in FIGS. 2A-2E, a portion of the second sliding sleeve 250 may be slidably fitted within the second sliding sleeve interaction portion 330 of the first sliding sleeve 240.

In the embodiment of FIG. 3, the first sliding sleeve 240 comprises a downhole orthogonal face 340. In an embodiment, the downhole orthogonal face 340 is configured such that a hydraulic force may be applied there against. In an embodiment, the downhole orthogonal face 340 is configured such that the application of a hydraulic force to the downhole orthogonal face 340 will impart an upward force to the first sliding sleeve 240. In an embodiment, the downhole orthogonal face 340 may comprise a beveled edge 342.

Figure 2A:
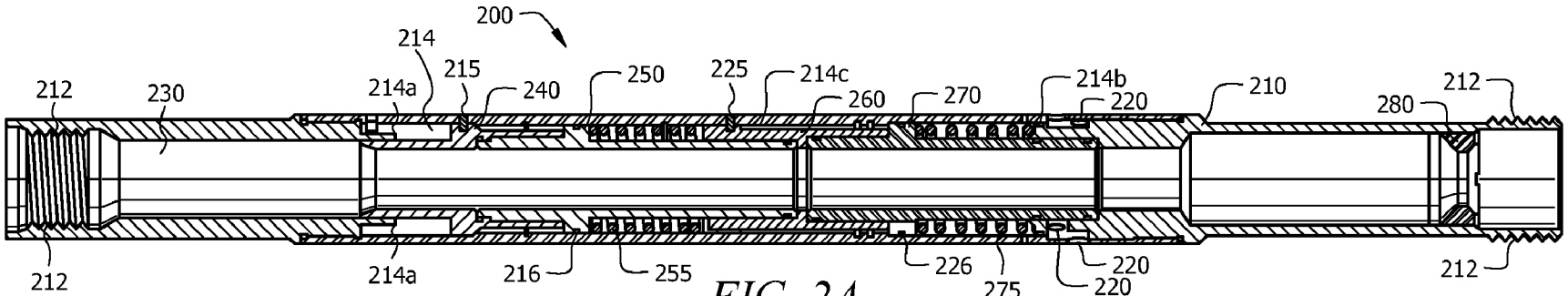
FIG. 2A is a cutaway view of a progressive pressurization actuated tool shown as configured prior to the application of any pressure.

In the embodiment of FIG. 2A, the first sliding sleeve 240 may be held in place by at least one shear pins 215. Such a shear pin 215 may extend between the body 210 and the first sliding sleeve 240. The shear pin 215 may be inserted or positioned within a suitable borehole in the body 210 and a borehole 325 (shown in FIG. 3) in the first sliding sleeve 240. As will be appreciated by one of skill in the art, shear pin 215 may be configured to shear or break when a desired magnitude of force is applied thereto.

Figure 4:
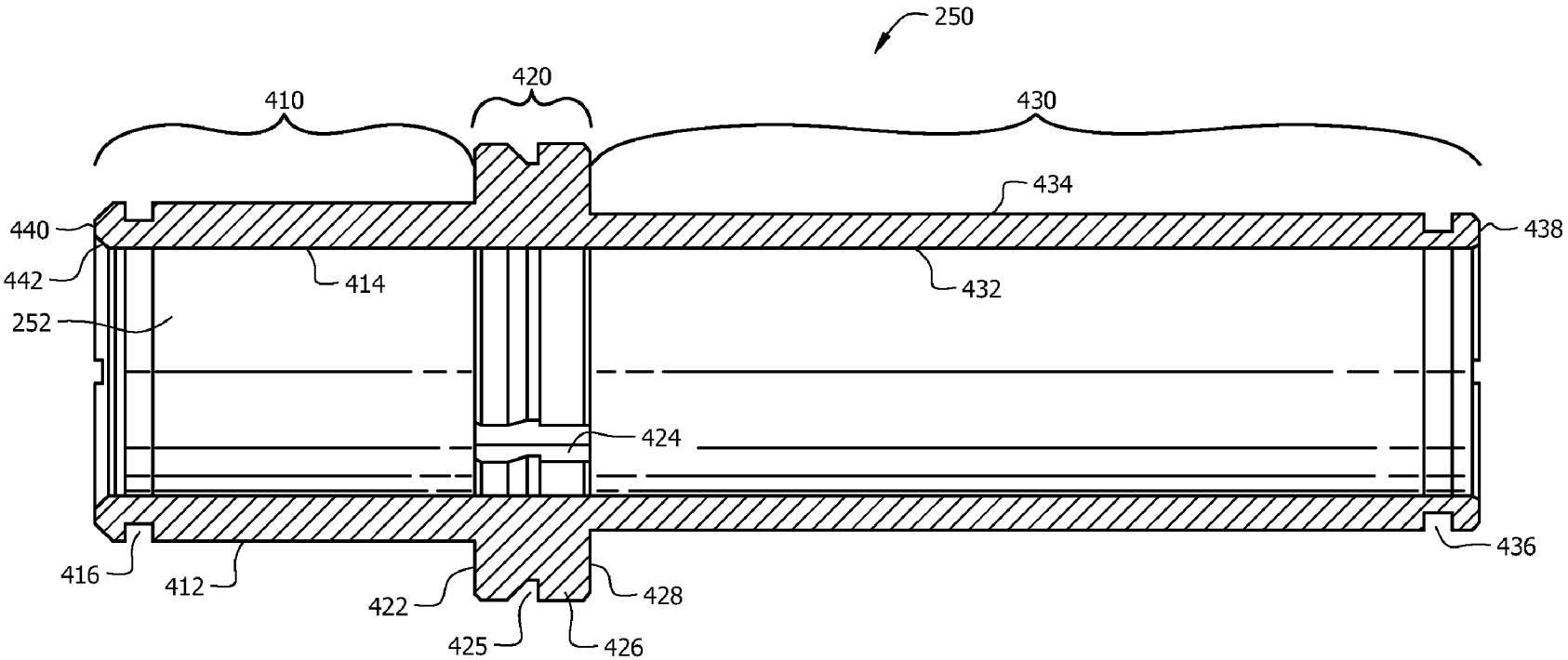
FIG. 4 is a cutaway view of a second sliding sleeve of a progressive pressurization actuated tool.

Referring to FIG. 4, the second sliding sleeve 250 is shown in isolation. In this embodiment, the second sliding sleeve 250 is generally cylindrical or tubular. In this embodiment, the second sliding sleeve 250 comprises an axial bore 252 extending therethrough.

In the embodiment of FIG. 4, the second sliding sleeve 250 generally comprises a first sliding sleeve interaction portion 410, a recessed raceway interaction portion 420, a third sliding sleeve interaction portion 430, and an uphole orthogonal face 440. In the embodiment of FIG. 4, the first sliding sleeve interaction portion 410, the recessed raceway interaction portion 420, the third sliding sleeve interaction portion 430, and the uphole orthogonal face 440 comprise a single solid piece. Alternatively, the first sliding sleeve interaction portion 410, the recessed raceway interaction portion 420, and the third sliding sleeve interaction portion 430 may be comprise two or more pieces coupled together, as will be appreciated by those of skill in the art.

In the embodiment of FIG. 4, the first sliding sleeve interaction portion 410 comprises an outer cylindrical surface 412 and an inner cylindrical surface 414. As shown in FIGS. 2A-2E, the outer cylindrical surface 412 is configured to slidably fit against a portion of the first sliding sleeve 240, particularly, to slidably fit against the second sliding sleeve interaction portion 330, disclosed herein above. The outer cylindrical surface 412 may be fitted against the inner cylindrical surface 332 of the second sliding sleeve interaction portion 330 in a substantially fluid-tight manner. The first sliding sleeve interaction portion 410 may comprise a groove 416 for the placement of a sealing or locking mechanism (e.g., an O-ring, snap-ring, or, lock-ring).

In the embodiment of FIG. 4, the recessed raceway interaction portion 420 is immediately adjacent to and below the first sliding sleeve interaction portion 410. In the embodiment of FIG. 4 and as shown in FIGS. 2A-2E, the recessed raceway interaction portion 420 comprises an outer surface 426 which is configured to slidably fit against recessed bore surface 214*c* of the recessed raceway 214. The recessed raceway interaction portion 420 may comprise an upper shoulder 422 and a lower shoulder 428. As shown in FIG. 4, the recessed raceway interaction portion 420 may comprise one or more conduits 424, thereby allowing for the passage of a fluid or liquid material from the uphole side of the recessed raceway interaction portion 420 to the downhole side thereof or from the downhole side thereof to the uphole side thereof. The recessed raceway interaction portion 420 may comprise a groove 425 for the placement of a sealing or locking mechanism (e.g., an O-ring, snap-ring, or, lock-ring). In an embodiment, a snap-ring or lock-ring 216 or the like is positioned within groove 425.

In the embodiment of FIG. 4, the third sliding sleeve interaction portion 430 is immediately adjacent to and below the recessed raceway interaction portion 420. As shown in FIGS. 2A-2E, the third sliding sleeve interaction portion 430 is configured to slidably fit within a portion of the third sliding sleeve 260. In the embodiment of FIG. 4, the third sliding sleeve interaction portion 430 comprises an inner cylindrical surface 432 and an outer cylindrical surface 434. The outer cylindrical surface 434 may be slidably fitted against a portion of third sliding sleeve 260. As shown in FIGS. 2A-2E, a portion of the third sliding sleeve 260 may be slidably fitted about the third sliding sleeve interaction portion 430 of the second sliding sleeve 250. The third sliding sleeve interaction portion 430 may comprise a groove 436 for the placement of a sealing and/or locking mechanism (e.g., an O-ring, snap-ring, or, lock-ring).

In the embodiment of FIG. 4, the second sliding sleeve 250 comprises an uphole orthogonal face 440. In an embodiment, the uphole orthogonal face 440 is configured such that a hydraulic force may be applied there against. In an embodiment, the uphole orthogonal face 440 is configured such that the application of a hydraulic force to the uphole orthogonal face 440 will impart a downward force to the second sliding sleeve 250. In an embodiment, the uphole orthogonal face 440 may comprise a beveled edge 442.

In the embodiment of FIGS. 2A-2E, the second sliding sleeve 250 is upwardly biased by a biasing member. In the embodiment of FIGS. 2A-2E, the biasing member comprises an upper spring 255. In an alternative embodiment, any suitable biasing member may be employed to upwardly bias the second sliding sleeve 250. In the embodiment of FIGS. 2A-2E, the upper spring 255 engages and/or contacts the lower shoulder 428 of the recessed raceway interaction portion 420. In an embodiment, the upper spring 255 is sized to apply a given force as will be discussed in greater detail herein.

Figure 5:
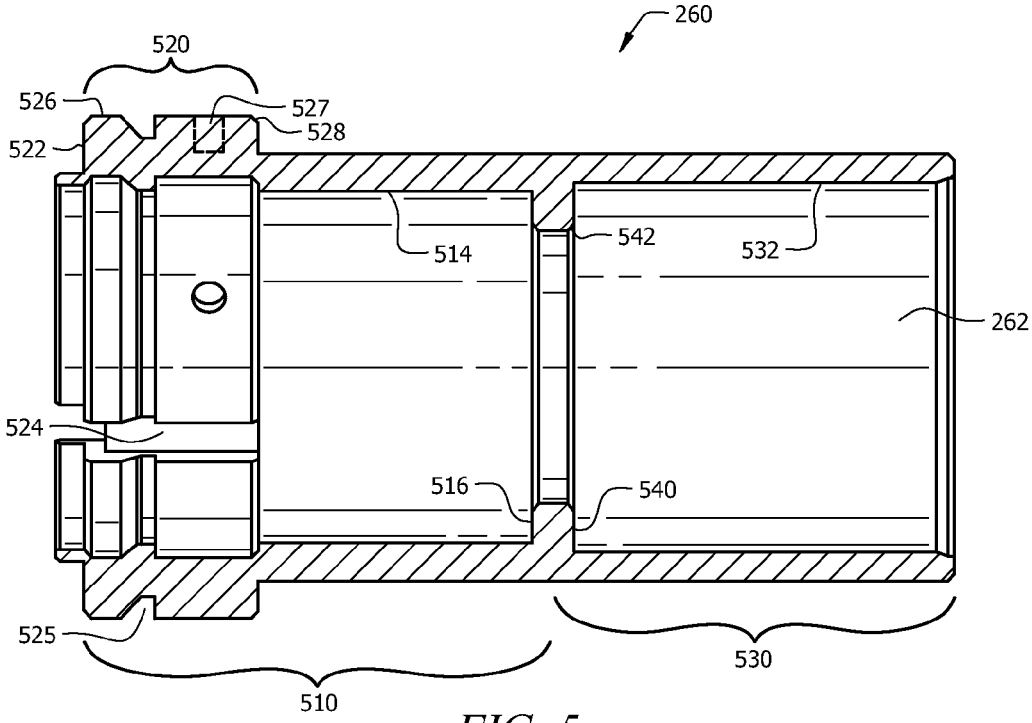
FIG. 5 is a cutaway view of a third sliding sleeve of a progressive pressurization actuated tool.

Referring to FIG. 5, the third sliding sleeve 260 is shown in isolation. In this embodiment, the third sliding sleeve 260 is generally cylindrical or tubular. In this embodiment, the third sliding sleeve 260 comprises an axial bore 262 extending therethrough.

In the embodiment of FIG. 5, the third sliding sleeve 260 generally comprises a second sliding sleeve interaction portion 510, a recessed raceway interaction portion 520, a fourth sliding sleeve interaction portion 530, and a downhole orthogonal face 540. In the embodiment of FIG. 5, the second sliding sleeve interaction portion 510, the recessed raceway interaction portion 520, the fourth sliding sleeve interaction portion 530, and the downhole orthogonal face 540 comprise a single solid piece. Alternatively, the second sliding sleeve interaction portion 510, the recessed raceway interaction portion 520, and the fourth sliding sleeve interaction portion 530 may be comprise two or more pieces operatively coupled together, as will be appreciated by those of skill in the art.

In the embodiment of FIG. 5, the second sliding sleeve interaction portion 510 comprises an inner cylindrical surface 514. As shown in FIGS. 2A-2E, the inner cylindrical surface 514 is configured to slidably fit against a portion of the second sliding sleeve 250. In an embodiment, the inner cylindrical surface 514 may be fitted against the outer cylindrical surface 434 of third sliding sleeve interaction portion 430 of the second sliding sleeve 250 in a substantially fluid-tight manner. In an embodiment, the second sliding sleeve interaction portion 510 comprises an uphole orthogonal face 516.

In the embodiment of FIG. 5, the recessed raceway interaction portion 520 is external to the second sliding sleeve interaction portion 510. In the embodiment of FIG. 5 and as shown in FIGS. 2A-2E, the recessed raceway interaction portion 520 comprises an outer surface 526 which is configured to slidably fit against recessed bore surface 214*c* of the recessed raceway 214. The recessed raceway interaction portion 520 may comprise an upper shoulder 522 and a lower shoulder 528. As shown in FIG. 5, the recessed raceway interaction portion 520 may comprise one or more conduits 524, thereby allowing for the passage of a fluid or liquid material from the uphole side of the recessed raceway interaction portion 520 to the downhole side thereof or from the downhole side thereof to the uphole side thereof. The second sliding sleeve interaction portion 510 may comprise a groove 525 for the placement of a sealing or locking mechanism (e.g., an O-ring, snap-ring, or, lock-ring).

In the embodiment of FIG. 5, the third sliding sleeve 260 comprises a downhole orthogonal face 540. In an embodiment, the downhole orthogonal face 540 is configured such that a hydraulic force may be applied there against. In an embodiment, the downhole orthogonal face 540 is configured such that the application of a hydraulic force to the downhole orthogonal face 540 will impart an upward force to the third sliding sleeve 260. In an embodiment, the downhole orthogonal face 540 may comprise a beveled edge 542.

In the embodiment of FIG. 5, the fourth sliding sleeve interaction portion 530 is immediately adjacent to and below the second sliding sleeve interaction portion 510. In an embodiment, a protrusion substantially defined by the uphole orthogonal face 516 and the downhole orthogonal face 540 separates the second sliding sleeve interaction portion 510 from the fourth sliding sleeve interaction portion 530. As shown in FIGS. 2A-2E, the fourth sliding sleeve interaction portion 530 is configured to slidably fit around a portion of the fourth sliding sleeve 270. In the embodiment of FIG. 5, the fourth sliding sleeve interaction portion 530 comprises an inner cylindrical surface 532 which may be slidably fitted against a portion of the fourth sliding sleeve 270. As shown in FIGS. 2A-2E, a portion of the fourth sliding sleeve 270 may be slidably fitted within the fourth sliding sleeve interaction portion 530 of the third sliding sleeve 260.

In the embodiment of FIG. 2A, the third sliding sleeve 260 is held in place by at least one shear pin 225. The shear pin 225 may extend between the body 210 and the third sliding sleeve 260. The shear pin may be inserted or positioned within a suitable borehole in the body 210 and a borehole 527 in the third sliding sleeve 260.

Figure 6:
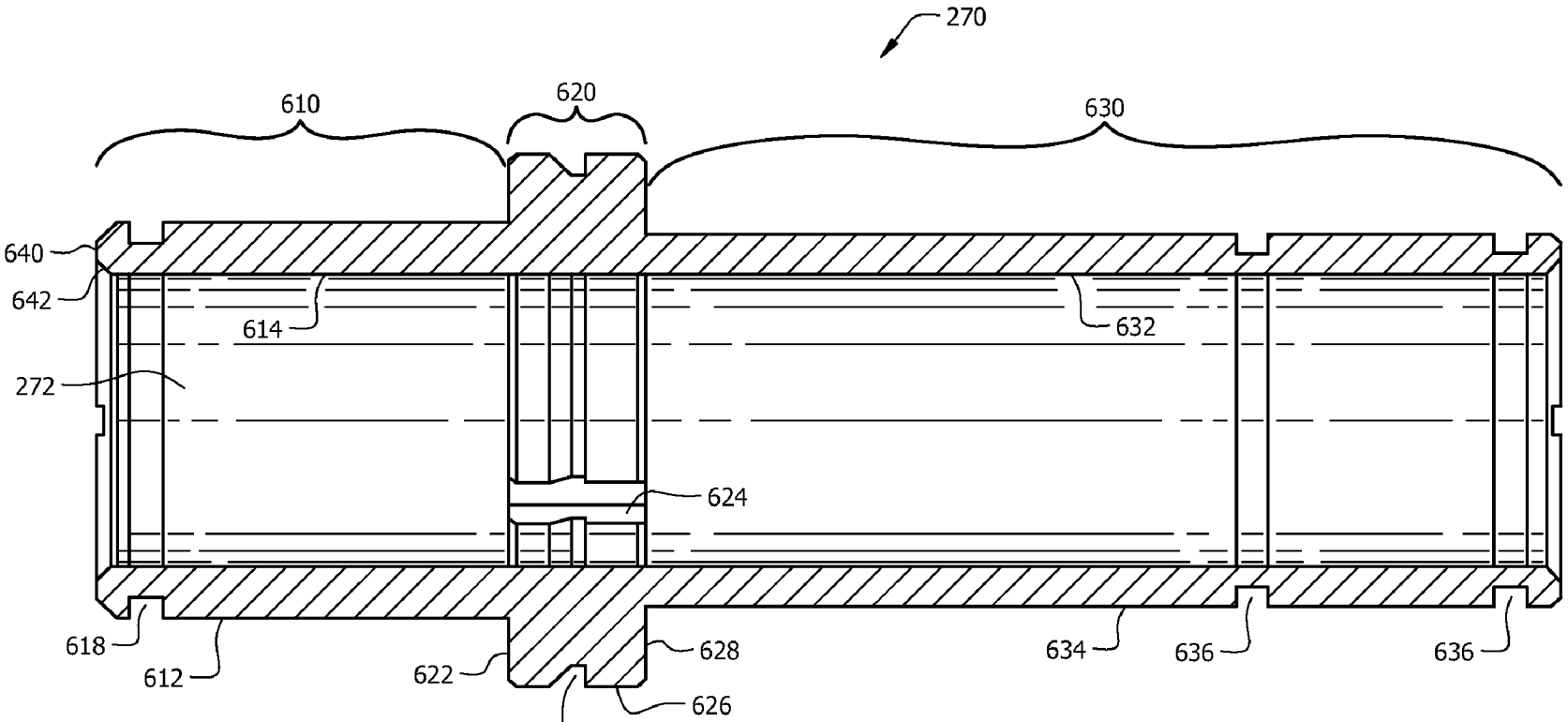
FIG. 6 is a cutaway view of a fourth sliding sleeve of a progressive pressurization actuated tool.

Referring to FIG. 6, the fourth sliding sleeve 270 is shown in isolation. In this embodiment, the fourth sliding sleeve 270 is generally cylindrical or tubular. In this embodiment, the fourth sliding sleeve 270 comprises an axial bore 272 extending therethrough.

In the embodiment of FIG. 6, the fourth sliding sleeve 270 generally comprises an third sliding sleeve interaction portion 610, a recessed raceway interaction portion 620, a port interaction portion 630, and an uphole orthogonal face 640. In the embodiment of FIG. 6, the third sliding sleeve interaction portion 610, the recessed raceway interaction portion 620, the port interaction portion 630, and the uphole orthogonal face 640 comprise a single solid piece. Alternatively, the third sliding sleeve interaction portion 610, the recessed raceway interaction portion 620, and the portion interaction portion 630 may be comprise two or more pieces coupled together, as will be appreciated by those of skill in the art.

In the embodiment of FIG. 6, the third sliding sleeve interaction portion 610 comprises an outer cylindrical surface 612 and an inner cylindrical surface 614. As shown in FIGS. 2A-2E, the outer cylindrical surface 612 is configured to slidably fit against a portion of the third sliding sleeve 260, particularly, to slidably fit against the inner surface 532 of the fourth sliding sleeve interaction portion 530 of the third sliding sleeve 260, disclosed herein above. The outer cylindrical surface 612 may be fitted against the inner surface 532 of the fourth sliding sleeve interaction portion 530 of the third sliding sleeve 260 in a substantially fluid-tight manner. The third sliding sleeve interaction portion 610 may comprise a groove 616 for the placement of a sealing or locking mechanism (e.g., an O-ring, snap-ring, or, lock-ring).

In the embodiment of FIG. 6, the recessed raceway interaction portion 620 is immediately adjacent to and below the third sliding sleeve interaction portion 610. In the embodiment of FIG. 6 and as shown in FIGS. 2A-2E, the recessed raceway interaction portion 620 comprises an outer surface 626 which is configured to slidably fit against recessed bore surface 214*c* of the recessed raceway 214. The recessed raceway interaction portion 620 may comprise an upper shoulder 622 and a lower shoulder 628. As shown in FIG. 6, the recessed raceway interaction portion 620 may comprise one or more conduits 624, thereby allowing for the passage of a fluid or liquid material from the uphole side of the recessed raceway interaction portion 620 to the downhole side thereof or from the downhole side thereof to the uphole side thereof. The recessed raceway interaction portion 620 may comprise a groove 625 for the placement of a sealing or locking mechanism (e.g., an O-ring, snap-ring, or, lock-ring). In an embodiment, a snap-ring or lock-ring 226 or the like is positioned within groove 625.

In the embodiment of FIG. 6, the port interaction portion 630 is immediately adjacent to and below the recessed raceway interaction portion 620. As shown in FIGS. 2A-2E, the port interaction portion 630 is configured to slidably fit over and thereby obscure the ports 220. In the embodiment of FIG. 6, the port interaction portion 630 comprises an inner cylindrical surface 632 and an outer cylindrical surface 634. As shown in FIGS. 2A-2E, the port interaction portion of the fourth sliding sleeve 270 may be slidably fitted against the inner surface of the body 210 so as to either allow or disallow fluid passage through the ports dependent upon whether the port interaction portion obscures the ports 220. The port interaction portion 630 may comprise one or more grooves 636 for the placement of a sealing or locking mechanism (e.g., an O-ring, snap-ring, or, lock-ring).

In the embodiment of FIG. 6, the fourth sliding sleeve 270 comprises an uphole orthogonal face 640. In an embodiment, the uphole orthogonal face 640 is configured such that a hydraulic force may be applied there against. In an embodiment, the uphole orthogonal face 640 is configured such that the application of a hydraulic force to the uphole orthogonal face 640 will impart a downward force to the fourth sliding sleeve 270. In an embodiment, the uphole orthogonal face 640 may comprise a beveled edge 642.

In the embodiment of FIGS. 2A-2E, the fourth sliding sleeve 270 is upwardly biased by a biasing member. In the embodiment of FIGS. 2A-2E, the biasing member comprises a lower spring 275. In an alternative embodiment, any suitable biasing member may be employed to upwardly bias the fourth sliding sleeve 270. In the embodiment of FIGS. 2A-2E, the lower spring 275 engages and/or contacts the lower shoulder 628 of the recessed raceway interaction portion 620. In an embodiment, the lower spring 275 is sized to apply a given force as will be discussed in greater detail herein.

In an embodiment, the PPAT 200 comprises an obturating component or a portion thereof. As will be appreciated by those of skill in the art, such an obturating component may be suitably employed to obturate, restrict, lessen, or cease a flow of fluid through the axial flowbore 230 of the PPAT 200. Suitable obturating components are generally known to those of skill in the art. In the embodiment of FIGS. 2A-2E, the obturating component comprises a seat 280. The seat 280 may be configured to engage a ball or other member, for example a dart, introduced into the axial flowbore 230. Upon engaging the seat, the ball or other member will lessen or restrict the flow of a fluid from the uphole side of the seat 280 to the downhole side of the seat.

In an embodiment, a wellbore servicing method utilizing the PPAT 200 is disclosed herein. Such a wellbore servicing method may generally comprise positioning a wellbore servicing apparatus 100 comprising the PPAT 200 within a wellbore 114, making a first application of pressure to the wellbore servicing apparatus 100, allowing the first application of pressure to the wellbore servicing apparatus 100 to subside, making a second application of pressure to the wellbore servicing apparatus 100, allowing the second application of pressure to the wellbore servicing apparatus 100 to subside, and communicating a fluid to the wellbore 114, the subterranean formation 102, or both via the PPAT 200. In an embodiment, the axial flowbore 230 will remain isolated from the wellbore 114 and/or the subterranean formation 102 until the pressure within the PPAT 200 falls below the lower threshold.

Referring again to FIG. 1, in an embodiment, the wellbore servicing method comprises positioning or "running in" a casing string 150 within wellbore 114. The casing string 150 may comprise a wellbore servicing apparatus 100; for example, the wellbore servicing apparatus 100 may be integrated within casing string 150. As such, the wellbore servicing apparatus 100 and the casing string 150 comprise a common axial flowbore. Thus, a fluid introduced into the casing string 150 will be communicated to the wellbore servicing apparatus 100.

As disclosed above, the wellbore servicing apparatus 100 may comprise one or more manipulatable servicing tools 160, one or more packers 170, the float shoe 180, and the PPAT 200. As such, positioning the wellbore servicing apparatus 100 may comprise positioning the PPAT 200. As will be appreciated by those of skill in the art, the casing string 150, wellbore servicing apparatus 100, or both may be configured such that, when positioned within the wellbore 114, at least one or more manipulatable servicing tools 160, the one or more packers 170, the float shoe 180, and/or the PPAT 200 will be positioned at a given or desirable depth within the wellbore 114.

The manipulatable servicing tool 160 may generally comprise a device or apparatus which is configured to be independently actuatable as to the way in which fluid is emitted therefrom. Such a manipulatable servicing tool 160 may be manipulated or actuated via a variety of means. In an embodiment, a manipulatable servicing tool 160 may be actuated by introducing an obturating member (e.g., a ball or dart) into the axial flowbore of the casing string 150 and circulating through the axial flowbore such that the obturating member engages a seat within the manipulatable servicing tool 160. Upon engaging such seat, pressure applied against the obturating member may actuate or manipulate the manipulatable servicing tool 160, thereby opening or closing one or more ports in the manipulatable servicing tool 160 and configuring the manipulatable servicing tool 160 for a given servicing operation. Once the manipulatable servicing tool 160 is actuated to perform a given wellbore servicing operation, fluids may be communicated from the interior, axial flowbore of the manipulatable servicing tool 160 to the wellbore 114, the subterranean formation 102, or both. Such a manipulatable servicing tool 160 may be employed, for example, in perforating, hydrajetting, acidizing, isolating, flushing, or fracturing operations. Nonlimiting discussion of manipulatable fracturing tools which may be suitably employed can be found in U.S. application Ser. No. 12/358,079, which is incorporated by reference herein in its entirety. Such manipulatable servicing tools are commercially available from Halliburton Energy Services in Duncan, Okla. as Delta Stim® Sleeves.

The packer 170 may generally comprise a device or apparatus which is configurable to seal or isolate two or more depths in a wellbore from each other by providing a barrier concentrically about a casing string and therebetween. Nonlimiting examples of a packer suitably employed as packer 170 include a mechanical packer, a swellable packer, or combinations thereof.

The float assembly 180 may be any suitable float assembly. Such float assemblies and the operation thereof are generally known to those of skill in the art. Nonlimiting examples of such a float assembly include a float shoe or the like. As will be appreciated by one of skill in the art, in an embodiment a float shoe may be employed to engage an obturating member (for example, a wiper dart, foam dart, ball, or the like) and thereby lessen or prevent the escape of fluid from a terminal end of a tubular string (e.g., the downhole end of the casing string 150).

Referring to FIG. 2A, the PPAT 200 is illustrated in a suitable run-in configuration. As shown, as the PPAT 200 is introduced into and/or positioned within the wellbore 114, the downhole orthogonal face 340 of the first sliding sleeve 240 is immediately adjacent to and abuts the uphole orthogonal face 440 of the second sliding sleeve 250, the first sliding sleeve 240 is held in place by at least one shear pin, the upper spring 255 is compressed, the lower shoulder 438 of the third sliding sleeve interaction portion 430 of the second sliding sleeve 250 is immediately adjacent to and abuts the lower shoulder 516 of the second sliding sleeve interaction portion 510 of the third sliding sleeve 260, the third sliding sleeve is held in place by at least one shear pin, the downhole orthogonal face 540 of the third sliding sleeve 260 is immediately adjacent to and abuts the uphole orthogonal face 640 of the fourth sliding sleeve 270, the lower spring 275 is compressed, and the port interaction portion 630 of the fourth sliding sleeve 270 obscures the ports 220 such that fluid communication between the axial flowbore 230 and the wellbore 114 in which the PPAT 200 is positioned or the adjacent subterranean formation 102 via the ports 220 is prohibited or restricted.

In an embodiment, the wellbore servicing method comprises actuating one or more the packers 170. In an embodiment, the packer 170 comprises a swellable packer such as a SwellPacker® commercially available from Halliburton Energy Services in Duncan, Okla. Such a swellable packer may swellably expand upon contact with an activation fluid (e.g. water, kerosene, diesel, or others), thereby providing a seal or barrier between adjacent zones or portions of the wellbore 114 or the subterranean formation 102. Actuating such a swellable packer may comprise introducing the activation fluid into the casing string 150, allowing the activation fluid to flow into the wellbore 114 (e.g., out of a downhole terminal end of the casing string 150) and thereby contact the swellable packer, and allowing the swellable packer to swell or expand to contact the walls of the wellbore 114, thereby providing a seal or barrier between adjacent zones or portions of the wellbore 114.

In an alternative embodiment, the one or more packers 170 may comprise mechanical packers. Alternatively, the packers 170 may comprise a combination of swellable and mechanical packers.

In an embodiment, the wellbore servicing method comprises displacing the activation fluid from all or a portion of the interior flowbore of the casing string 150. Suitable means of displacing activation fluid are generally known to those of skill in the art. A nonlimiting example of displacing the activation fluid comprises introducing a wiper plug into the casing and forward circulating the wiper plug until the wiper plug reaches the float shoe 170 or terminal end of the casing string. Not to be limited, a suitable wiper plug may comprises a flexible portion which will expand or contract as it moves through the casing string, thereby removing any remaining activation fluid.

In an embodiment, the wellbore servicing method comprises introducing an obturating member into the casing string. Nonlimiting examples suitable obturating members include a ball, dart, plug, or the like. The obturating member may be circulated through the casing string 150 to engage the seat 280 and thereby obstruct the passage of fluid beyond the seat 280. In an embodiment, after the obturating member has reached and engaged the seat 280, no fluid pathway will exist between the axial flowbore of the casing string and the wellbore 114 and/or the subterranean formation 102.

In an embodiment, the wellbore servicing method comprises making a first application of pressure within the PPAT 200, such that the pressure within the PPAT 200 reaches at least an upper threshold. In an embodiment, the pressure is applied via a fluid pumped through the casing string 150. In an embodiment, the upper threshold pressure may be at least about 1,000 p.s.i., alternatively, at least about 1,500 p.s.i., alternatively, at least about 2,000 p.s.i., alternatively, at least about 2,500 p.s.i., alternatively, at least about 3,000 p.s.i., alternatively, at least about 4,000 p.s.i., alternatively, at least about 4,500 p.s.i., alternatively, at least about 5,000 p.s.i., alternatively, any suitable pressure less than the casing test pressure and/or the pressure at which the casing is rated. In an embodiment, the upper threshold may be such that the hydraulic force parallel to the axial flowbore applied to the first sliding sleeve 240 may be sufficient to cause the shear pin 215 to be sheared. In various embodiments, the shear pin 215 may be sized so as to shear upon the application of a desired force thereto.

Figure 2B:
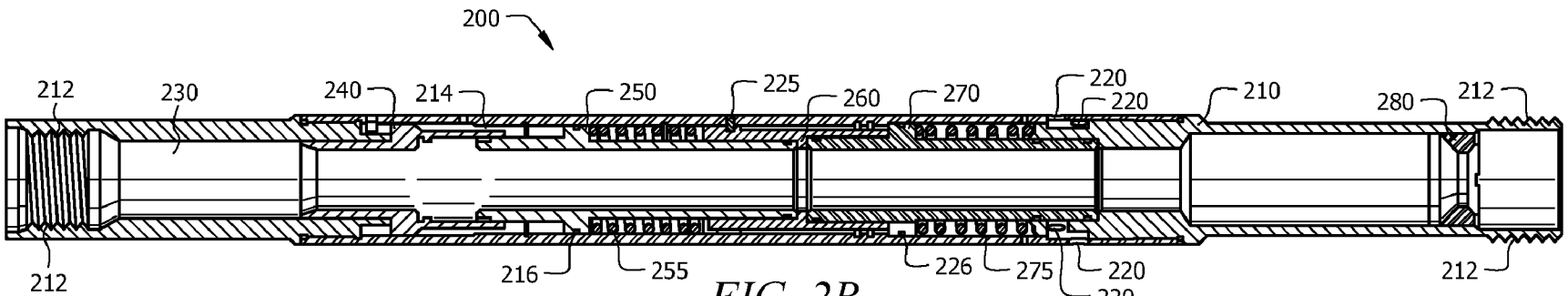
FIG. 2B is a cutaway view of a progressive pressurization actuated tool shown in as configured during a first application of pressure.

Referring to FIGS. 2A and 2B, prior to the first application of pressure, the downhole orthogonal face 340 of the first sliding sleeve 240 is immediately adjacent to and abuts the uphole orthogonal face 440 of the second sliding sleeve 250 and the first sliding sleeve 240 is held in place by at least one shear pin.

When the first application of pressure is made to the PPAT 200, a hydraulic force is applied by the fluid in an upward direction against the downhole orthogonal face 340 of the first sliding sleeve 240 and a hydraulic force is applied by the fluid in a downward direction against the uphole orthogonal face 440 of the second sliding sleeve 250.

Even though the downhole orthogonal face 340 of the first sliding sleeve abuts the uphole orthogonal face 440 of the second sliding sleeve 250, beveled edges 342 and 442 of the first sliding sleeve 240 and the second sliding sleeve 250 respectively, allow the pressurized fluid to apply opposing hydraulic forces to the first sliding sleeve 240 and the second sliding sleeve 250. The hydraulic force shears the one or more shear pins holding the first sliding sleeve 240 in place, thereby causing the first sliding sleeve 240 to slide upward until the upper shoulder 322 of the recessed raceway interacting portion 320 of the first sliding sleeve 240 contacts and/or presses against the upper shoulder 214*a* of the recessed raceway of the body 210, thereby prohibiting the first sliding sleeve 240 from continuing to slide upward. Even though the second sliding sleeve 250 is biased upward by the upper spring 255, the hydraulic force applied by the fluid in a downward direction against the uphole orthogonal face 440 of the second sliding sleeve 250 is greater than the upward biasing force of the upper spring 255. That is, the net downward hydraulic force and the net upward hydraulic force applied to the second sliding sleeve 250, the third sliding sleeve 260 and/or the fourth sliding sleeve 270 may be about equal. Thus, the second sliding sleeve 250 remains unmoved. Further, the downward hydraulic force applied to the second sliding sleeve 250 may be transferred to the third sliding sleeve 260, the fourth sliding sleeve 270, or both. Thus, the position of the third sliding sleeve 260 and the fourth sliding sleeve 270 remain unchanged as well.

As will be appreciated by one of skill in the art, shear pins may be employed which will shear upon the application of a given magnitude of force. As will be appreciated by one of skill in the art, shear pins varying as to shearing force may be employed. As such, in an embodiment a PPAT may be configured such that a given magnitude of hydraulic pressure may be applied thereto (e.g., the upper threshold) before the shear pin will shear. Because shear pins vary as to shearing force, the hydraulic pressure applied to the PPAT may be varied by employing various shear pins.

In an embodiment, the wellbore servicing method comprises allowing the first application of pressure within the PPAT to fall below a lower threshold. In an embodiment, the lower threshold pressure may be less than about 1,500 p.s.i., alternatively, less than about 1,000 p.s.i., alternatively, less than about 500 p.s.i., alternatively, about 0 p.s.i. In an embodiment, the lower threshold may be such that the force parallel to the axial flowbore applied to the second sliding sleeve 250 via the upper spring 255 is greater than the hydraulic force parallel to the axial flowbore applied to the second sliding sleeve 250.

Figure 2C:
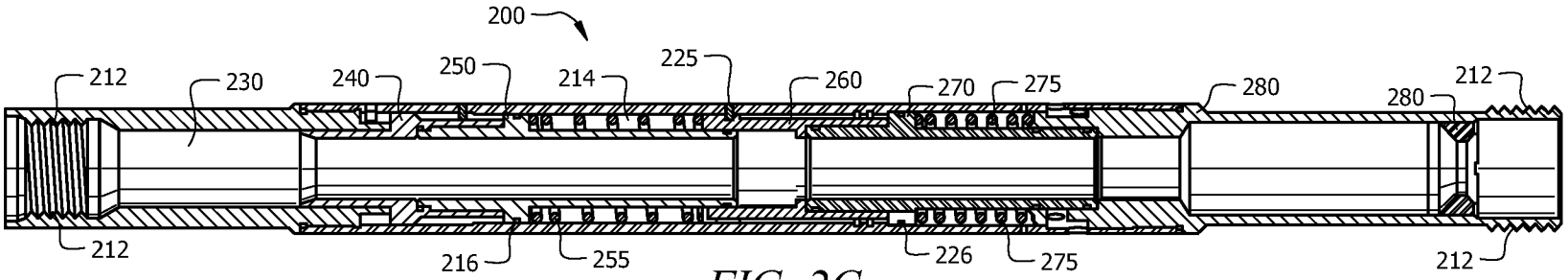
FIG. 2C is a cutaway view of a progressive pressurization actuated tool shown in as configured following a first application of pressure and prior to a second application of pressure.

Referring to FIG. 2C, when the first application of pressure to the PPAT falls below the lower threshold the hydraulic force applied by the fluid in a downward direction against the uphole orthogonal face 440 of the second sliding sleeve 250 ceases to be greater than the upward biasing force of the upper spring 255 (e.g., the force applied by the upper spring 255 overcomes any frictional forces and any differential fluid pressure). Thus, the biasing force of the upper spring 255 causes the second sliding sleeve 250 to slide upwards until the downhole orthogonal face 340 of the first sliding sleeve contacts and/or presses against the uphole orthogonal face 440 of the second sliding sleeve 250, thereby prohibiting the second sliding sleeve 250 from continuing to slide upward. A locking mechanism (e.g., snap-ring or lock-ring 216 positioned within groove 425) may engage an adjacent groove, channel, dog, catch, or the like within/along the recessed bore surface 214*c* of the body 210, thereby preventing or restricting the second sliding sleeve 250 from further movement. The position of the third sliding sleeve 260 and the fourth sliding sleeve 270 remain unchanged.

In an embodiment, the wellbore servicing method comprises making a second application of pressure within the PPAT, such that the pressure within the PPAT reaches at least an upper threshold. In an embodiment, the upper threshold pressure may be at least about 1,000 p.s.i., alternatively, at least about 1,500 p.s.i., alternatively, at least about 2,000 p.s.i., alternatively, at least about 2,500 p.s.i., alternatively, at least about 3,000 p.s.i., alternatively, at least about 4,000 p.s.i., alternatively, at least about 4,500 p.s.i., alternatively, at least about 5,000 p.s.i., alternatively, any suitable pressure less than the casing test pressure and/or the pressure at which the casing is rated. In an embodiment, the upper threshold may be such that the hydraulic force parallel to the axial flowbore applied to the third sliding sleeve 260 may be sufficient to cause the shear pin 225 to be sheared. In various embodiments, the shear pin 225 may be sized so as to shear upon the application of a desired force thereto.

Figure 2D:
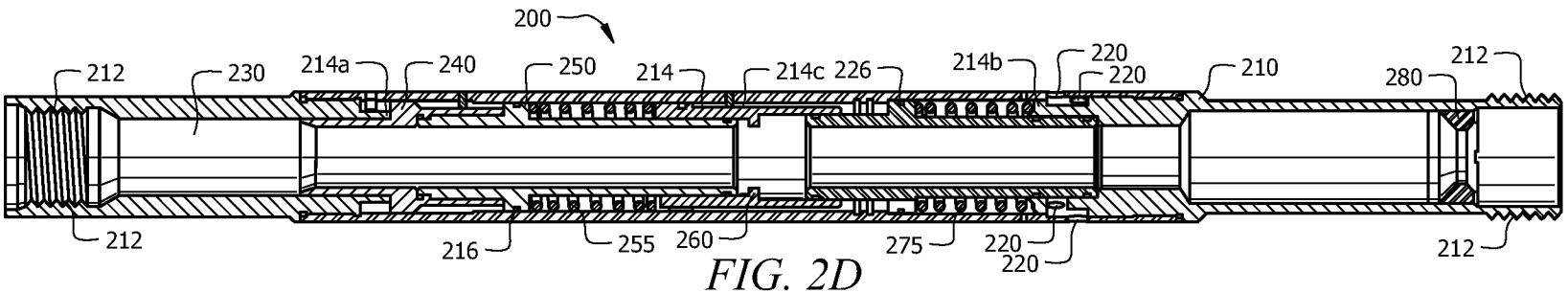
FIG. 2D is a cutaway view of a progressive pressurization actuated tool shown in as configured during a second application of pressure.

Referring to FIG. 2D, when the second application of pressure is made to the PPAT 200, a hydraulic force is applied by the fluid in an upward direction against the downhole orthogonal face 540 of the third sliding sleeve 260 and a hydraulic force is applied by the fluid in a downward direction against the uphole orthogonal face 640 of the fourth sliding sleeve 270. Even though the downhole orthogonal face 540 of the third sliding sleeve 260 abuts the uphole orthogonal face 640 of the fourth sliding sleeve 270, beveled edges 542 and 642 of the third sliding sleeve 260 and the fourth sliding sleeve 270 respectively, allow the pressurized fluid to apply opposing hydraulic forces to the third sliding sleeve 260 and the second sliding sleeve 270. The hydraulic force shears the one or more shear pins holding the third sliding sleeve 260 in place, thereby allowing the third sliding sleeve 260 to slide upward until the lower face 438 of the third sliding sleeve interaction portion 430 of the second sliding sleeve 250 contacts and/or presses against the lower face 516 of the second sliding sleeve interaction portion 510 of the third sliding sleeve 260, thereby prohibiting the third sliding sleeve 260 from continuing to slide upward. That is, the net downward hydraulic force and the net upward hydraulic force applied to the fourth sliding sleeve 270 may be about equal. Even though the fourth sliding sleeve 270 is biased upward by the lower spring 275, the hydraulic force applied by the fluid in a downward direction against the uphole orthogonal face 640 of the fourth sliding sleeve 270 is greater than the upward biasing force of the upper spring 275. Thus, the fourth sliding sleeve 270 remains unmoved.

Even though a net downward hydraulic force may be applied to the second sliding sleeve 250 (e.g., via the uphole orthogonal face 440 of the second sliding sleeve 250), because the second sliding sleeve 250 engages the recessed bore surface 214*c* of the body 210 (e.g., via snap-ring or lock-ring 216 positioned within groove 425), the second sliding sleeve is restricted from moving downward.

In an embodiment, the wellbore servicing method comprises allowing the second application of pressure within the PPAT to fall below a lower threshold. In an embodiment, the lower threshold pressure may be less than about 1,500 p.s.i., alternatively, less than about 1,000 p.s.i., alternatively, less than about 500 p.s.i., alternatively, about 0 p.s.i. In an embodiment, the lower threshold may be such that the force parallel to the axial flowbore applied to the fourth sliding sleeve 270 via the lower spring 275 is greater than the hydraulic force parallel to the axial flowbore applied to the fourth sliding sleeve 270.

Figure 2E:
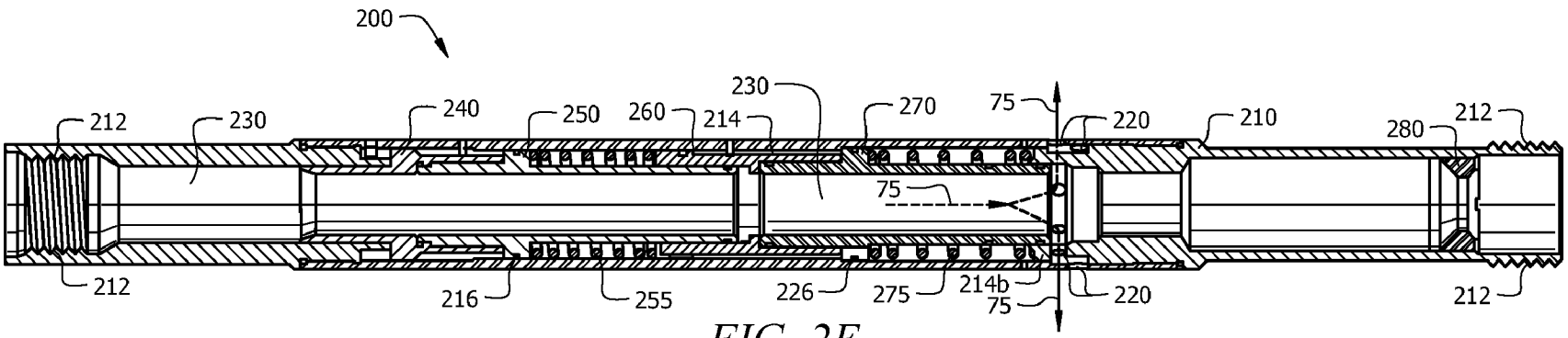
FIG. 2E is a cutaway view of a progressive pressurization actuated tool shown in as configured following a second application of pressure and as configured to allow a fluid pathway out of the progressive pressurization actuated tool.

Referring to FIG. 2E, when the second application of pressure to the PPAT 200 falls below the lower threshold the hydraulic force applied by the fluid in a downward direction against the uphole orthogonal face 640 of the fourth sliding sleeve 270 ceases to be greater than the upward biasing force of the lower spring 275 (e.g., the force applied by the lower spring 275 overcomes any frictional forces and any differential fluid pressure). Thus, the biasing force of the lower spring 275 causes the fourth sliding sleeve 270 to slide upwards until the downhole orthogonal face 540 of the third sliding sleeve contacts and/or presses against the uphole orthogonal face 640 of the fourth sliding sleeve 270, thereby prohibiting the fourth sliding sleeve 270 from continuing to slide upward. Also shown in FIG. 2E, when the second application of pressure to the PPAT 200 falls below the lower threshold and the fourth sliding sleeve 270 slides upward, the fourth sliding sleeve 270 will no longer obscure the ports 220. A locking mechanism (e.g., snap-ring or lock-ring 226 positioned within groove 625) may engage an adjacent groove, channel, dog, catch, or the like within/along the recessed bore surface 214*c* of the body 210, thereby preventing or restricting the fourth sliding sleeve 270 from further movement. As such, the ports 220 will provide a route of fluid communication between the axial flowbore 230 and the wellbore 114 and/or the subterranean formation 102. In an embodiment, the PPAT may be configured to communicate a fluid between the axial flowbore 230 and the wellbore 114 and/or the subterranean formation 102 only upon allowing the second application of pressure within the PPAT 200 to fall below the lower threshold (i.e., until the pressure within the PPAT 200 falls below the lower threshold, the axial flowbore 230 will remain isolated from the wellbore 114 and/or the subterranean formation 102).

In an embodiment, the wellbore servicing method comprises communicating a fluid between the axial flowbore 230 and the wellbore 114, the subterranean formation 102, or both via the ports 220 of the PPAT 200, as represented by flow arrows 75 shown in FIG. 2E.

In an embodiment, communicating a fluid to the wellbore 114, the subterranean formation 102, or both via the ports 220 of the PPAT 200 comprises a fracturing operation. In such an embodiment, the fluid communicated may comprise a fracturing fluid. The fracturing fluid may be communicated at a pressure sufficient to form and/or extend a fracture in the subterranean formation 102.

In an alternative embodiment, communicating a fluid to the wellbore 114, the subterranean formation 102, or both via the ports 220 of the PPAT 200 comprises a hydrajetting operation. In such a hydrajetting operation, the ports 220 may be suitably fitted with nozzles suitable for such hydrajetting operations. Such nozzles may be conventional, erodible, or otherwise suitable types, as will be appreciated by those of skill in the art. In such an embodiment, the fluid communicated may comprise a hydrajetting fluid. The hydrajetting fluid may be communicated as a pressure sufficient to initiate, extend, and/or form a perforation in the subterranean formation 102.

In an alternative embodiment, communicating a fluid to the wellbore 114, the subterranean formation 102, or both via the ports 220 of the PPAT 200 comprises allowing a fluid to flow into the annular space about the casing and/or into the formation (e.g., existing and/or previously formed fractures). As will be appreciated by those of skill in the art, in order to actuate one or more of the manipulatable servicing tools 160 incorporated within the casing string 150, an obturing member, for example a ball or dart, may be circulated through the casing string so as to engage a seat operably coupled to a port or window within the manipulatable servicing tool 160 and thereby configure the manipulatable servicing tool 160 for a given servicing operation. By allowing fluid to flow out of the ports 220 of the PPAT, the obturating member may be circulated through the casing so as to engage the seat. In an embodiment, the manipulatable servicing tool 160 comprises a Delta Stim® Sleeve that is opened and a fracturing operation is subsequently performed (e.g., fracturing fluid may be pumped through the manipulatable servicing tool 160 and into the formation 102). Delta Stim® Sleeves are commercially available via Halliburton Energy Services in Duncan, Okla.

Even though a net downward hydraulic force (e.g., via the hydraulic force of a fluid being communicated to the subterranean formation 102) may be applied to the fourth sliding sleeve 270 (e.g., via the uphole orthogonal face 640 of the fourth sliding sleeve 270), because the fourth sliding sleeve 270 engages the recessed bore surface 214*c* of the body 210 (e.g., via snap-ring or lock-ring 226 positioned within groove 625), the fourth sliding sleeve 270 is restricted from moving downward.

In various embodiments, the methods, systems, and devices disclosed herein may be advantageously employed to allow an operator to make multiple applications of pressure to a casing string comprising a PPAT while maintaining wellbore control. As explained above, when a casing string is positioned within a wellbore penetrating a subterranean formation, an operator may desire to pressure-test the casing string by applying an internal pressure to the casing string to ensure the integrity thereof. Following such an initial pressure-testing, the operator may desire to remove various surface equipment (e.g., a drilling, servicing, or workover rig) prior to continuing servicing operations. As such, the cased well may be left unattended for some period of time until any further servicing operations are commenced. When further wellbore servicing operations (e.g., fracturing operations) are commenced, the operator may again desire to pressure-test the casing string. As such, the methods, systems, and devices disclosed herein may be employed to allow multiple pressure-testing cycles while maintaining wellbore control in the time period between pressure-testing cycles and provide a route of fluid communication following the final pressure-testing cycle.

Further in an embodiment additional configurations comprising additional sliding sleeves, shear pins, and springs may be added or incorporated so as to provide an operator with the potential to perform additional pressure testing cycles.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

The invention claimed is:

1. A method of servicing a subterranean formation comprising:

positioning a wellbore servicing tool comprising an axial flowbore within a wellbore;

making a first application of pressure to the axial flowbore of the wellbore servicing tool, wherein the pressure within the wellbore servicing tool is at least a first upper threshold during the first application of pressure, wherein making the first application of pressure causes a first sliding sleeve positioned within the wellbore servicing tool to slide in a direction away from a second sliding sleeve;

allowing the pressure within the axial flowbore following the first application of pressure to fall below a first lower threshold, wherein allowing the pressure within the axial flowbore following the first application of pressure to fall below a first lower threshold causes the second sliding sleeve positioned within the wellbore servicing tool to slide in a direction away from a third sliding sleeve;

making a second application of pressure to the axial flowbore of the wellbore servicing tool, wherein the pressure within the wellbore servicing tool is at least a second upper threshold during the second application of pressure;

allowing the pressure within the axial flowbore following the second application of pressure to fall below a second lower threshold; and communicating a fluid to the wellbore, the subterranean formation, or both via one or more ports of the wellbore servicing tool.

2. The method of claim 1, wherein the axial flowbore of the wellbore servicing tool remains isolated from the wellbore, the subterranean formation, or both until after the pressure within the axial flowbore following the second application of pressure to the axial flowbore has fallen below the second lower threshold.

3. The method of claim 1, wherein the first upper threshold, the second upper threshold, or both is at least about 3000 p.s.i.

4. The method of claim 1, wherein the first lower threshold, the second lower threshold, or both is less than about 1000 p.s.i.

5. The method of claim 1, wherein making the second application of pressure causes the third sliding sleeve positioned within the wellbore servicing tool to slide in a direction away from a fourth sliding sleeve.

6. The method of claim 5, wherein allowing the pressure within the axial flowbore following the second application of pressure to fall below the second lower threshold causes the fourth sliding sleeve positioned within the wellbore servicing tool to slide, thereby providing a route of fluid communication via one or more ports in the tool.

7. A wellbore servicing tool comprising:

a cylindrical body comprising an axial flowbore and one or more ports;

a first sliding sleeve concentrically inserted within the cylindrical body and configured such that a first application of pressure within the axial flowbore will cause the first sliding sleeve to move within the cylindrical body;

a second sliding sleeve concentrically inserted within the cylindrical body and configured such that a subsiding of the first application of pressure with the axial flowbore will cause the second sliding sleeve to move within the cylindrical body;

a third sliding sleeve concentrically inserted within the cylindrical body and configured such that a second application of pressure within the axial flowbore will cause the third sliding sleeve to move within the cylindrical body; and a fourth sliding sleeve concentrically inserted within the cylindrical body and configured such that a subsiding of the second application of pressure with the axial flowbore will cause the second sliding sleeve to move within the cylindrical body, thereby exposing the ports.

8. The wellbore servicing tool of claim 7, further comprising:

a first biasing force applied to the second sliding sleeve; and a second biasing force applied to the fourth sliding sleeve.

9. The wellbore servicing tool of claim 7, wherein the first sliding sleeve comprises a surface against which a hydraulic force may be applied in a first direction.

10. The wellbore servicing tool of claim 9, wherein the second sliding sleeve comprises a surface against which a hydraulic force may be applied in a second direction.

11. The wellbore servicing tool of claim 10, wherein the third sliding sleeve comprises a surface against which a hydraulic force may be applied in the first direction.

12. The wellbore servicing tool of claim 11, wherein the fourth sliding sleeve comprises a surface against which a hydraulic force may be applied in the second direction.

13. A method of servicing a subterranean formation comprising:

positioning a wellbore servicing tool comprising an axial flowbore within a wellbore;

making a first application of pressure to the axial flowbore of the wellbore servicing tool, wherein the pressure within the wellbore servicing tool is at least a first upper threshold during the first application of pressure, wherein making the first application of pressure causes a first sliding sleeve positioned within the wellbore servicing tool to slide in a direction away from a second sliding sleeve positioned within the wellbore servicing tool; and allowing the first application of pressure within the axial flowbore to fall below a first lower threshold, wherein allowing the pressure within the axial flowbore following the first application of pressure to fall below a first lower threshold causes the second sliding sleeve to slide in a direction away from a third sliding sleeve positioned within the wellbore servicing tool, wherein the axial flowbore of the wellbore servicing tool remains isolated from the wellbore, the subterranean formation, or both until after making a second application of pressure of at least a second upper threshold to the axial flowbore of the wellbore servicing tool and allowing the second application of pressure within the axial flowbore to fall below a second lower threshold.

14. The method of claim 13, wherein the first upper threshold, the second upper threshold, or both is at least about 3000 p.s.i.

15. The method of claim 13, wherein the first lower threshold, the second lower threshold, or both is less than about 1000 p.s.i.

16. The method of claim 13, wherein making the second application of pressure causes the third sliding sleeve to slide in a direction away from a fourth sliding sleeve positioned within the wellbore servicing tool.

17. The method of claim 16, wherein allowing the second application of pressure within the axial flowbore to fall below the second lower threshold causes the fourth sliding sleeve to slide.

18. A method of servicing a subterranean formation comprising:

accessing a wellbore having disposed therein a wellbore servicing tool, wherein a first application of pressure of at least a first upper threshold has been made to an axial flowbore of the wellbore servicing tool, thereby having caused a first sliding sleeve positioned within the wellbore servicing tool to slide in a direction away from a second sliding sleeve positioned within the wellbore servicing tool, and wherein the first application of pressure within the axial flowbore has been allowed to fall below a first lower threshold, thereby having caused the second sliding sleeve to slide in a direction away from a third sliding sleeve positioned within the wellbore servicing tool;

making a second application of pressure to the axial flowbore of the wellbore servicing tool, wherein the pressure within the wellbore servicing tool is at least a second upper threshold during the second application of pressure, wherein making the second application of pressure causes the third sliding sleeve to slide in a direction away from a fourth sliding sleeve positioned within the wellbore servicing tool;

allowing the second application of pressure within the axial flowbore to fall below a second lower threshold, wherein allowing the pressure within the axial flowbore following the second application of pressure to fall below a second lower threshold causes the fourth sliding sleeve; and communicating a fluid to the wellbore, the subterranean formation, or both via a one or more ports of the wellbore servicing tool.

19. The method of claim 18, wherein the first upper threshold, the second upper threshold, or both is at least about 3000 p.s.i.

20. The method of claim 18, wherein the first lower threshold, the second lower threshold is less than about 1000 p.s.i.

21. The method of claim 18, wherein the axial flowbore of the wellbore servicing tool remains isolated from the wellbore, the subterranean formation, or both until after the pressure within the axial flowbore following the second application of pressure to the axial flowbore has fallen below the second lower threshold.

22. A wellbore servicing apparatus comprising:

a body comprising one or more ports;

an axial flowbore;

a first sleeve slidably fitted within the body and selectively retained relative to the body;

a second sleeve slidably fitted within the body abutting the first sleeve and biased toward the first sleeve;

a third sleeve slidably fitted within the body abutting the second sleeve and selectively retained relative to the body; and a fourth sleeve slidably fitted within the body abutting the third sleeve and biased toward the third sleeve, wherein the fourth sleeve obstructs fluid communication between the axial flowbore and the one or more ports.

23. A method of servicing a wellbore comprising:

positioning a wellbore servicing apparatus comprising:

a body comprising one or more ports;

an axial flowbore;

a first sleeve slidably fitted within the body and selectively retained relative to the body;

a second sleeve slidably fitted within the body abutting the first sleeve and biased toward the first sleeve;

a third sleeve slidably fitted within the body abutting the second sleeve and selectively retained relative to the body; and a fourth sleeve slidably fitted within the body abutting the third sleeve and biased toward the third sleeve, wherein the fourth sleeve obstructs fluid communication between the axial flowbore and the one or more ports;

applying a first application of pressure to the axial flowbore such that the first sleeve slides within the body;

allowing the pressure within the axial flowbore following the first application of pressure to subside, thereby allowing the second sleeve to slide within the body;

applying a second application of pressure to the axial flowbore such that the third sleeve slides within the body;

allowing the pressure within the axial flowbore following the first application of pressure to subside, thereby allowing the fourth sleeve to slide within the body such that the fourth sleeve no longer obstructs fluid communication between the axial flowbore and the one or more ports.

24. The method of claim 23, wherein the fluid communicated between the axial flowbore and the one or more ports comprises a fracturing fluid.

25. A method of servicing a wellbore comprising:

positioning a wellbore servicing apparatus comprising:

a body comprising one or more ports;

an axial flowbore;

a first sleeve slidably fitted within the body and selectively retained relative to the body;

a second sleeve slidably fitted within the body abutting the first sleeve and biased toward the first sleeve;

a third sleeve slidably fitted within the body abutting the second sleeve and selectively retained relative to the body; and a fourth sleeve slidably fitted within the body abutting the third sleeve and biased toward the third sleeve, wherein the fourth sleeve obstructs fluid communication between the axial flowbore and the one or more ports;

applying a first application of pressure to the axial flowbore such that the first sleeve slides within the body; and allowing the pressure within the axial flowbore following the first application of pressure to subside, thereby allowing the second sleeve to slide within the body, wherein the fourth sleeve continues to obstruct fluid communication between the axial flowbore and the one or more ports until after a second application of pressure to cause the third sleeve to slide within the body and allowing the second application of pressure within the axial flowbore following the second application of pressure to subside, thereby allowing the fourth sleeve to slide within the body.

26. A method of servicing a wellbore comprising:

accessing a wellbore servicing apparatus comprising:

a body comprising one or more ports;

an axial flowbore;

a first sleeve slidably fitted within the body and selectively retained relative to the body;

a second sleeve slidably fitted within the body abutting the first sleeve and biased toward the first sleeve;

a third sleeve slidably fitted within the body abutting the second sleeve and selectively retained relative to the body; and a fourth sleeve slidably fitted within the body abutting the third sleeve and biased toward the third sleeve, wherein the fourth sleeve obstructs fluid communication between the axial flowbore and the one or more ports, wherein a first application of pressure has been made to the axial flowbore such that the first sleeve slides within the body, and wherein the pressure within the axial flowbore following the first application of pressure has been allowed to subside, thereby allowing the second sleeve to slide within the body;

applying a second application of pressure to the axial flowbore such that the third sleeve slides within the body; and allowing the pressure within the axial flowbore following the first application of pressure to subside, thereby allowing the fourth sleeve to slide within the body such that the fourth sleeve no longer obstructs fluid communication between the axial flowbore and the one or more ports.

* * * * *